US012781497B2

(12) United States Patent
Knudson et al.

(10) Patent No.: US 12,781,497 B2
(45) Date of Patent: Nov. 3, 2026

(54) CORRUGATED SHEARWALL

(71) Applicant: Simpson Strong-Tie Company Inc., Pleasanton, CA (US)

(72) Inventors: Caleb Knudson, Mill Valley, CA (US); Mary Nunneley, Danville, CA (US); Tan Minh Nguyen, Ho Chi Minh City (VN); Tom McClain, Mountain Ranch, CA (US); Damon Ho, Chino Hills, CA (US)

(73) Assignee: Simpson Strong-Tie Company Inc., Pleasanton, CA (US)

( * ) Notice: Subject to any disclaimer, the term of this patent is extended or adjusted under 35 U.S.C. 154(b) by 108 days.

(21) Appl. No.: 18/407,637

(22) Filed: Jan. 9, 2024

(65) Prior Publication Data

US 2025/0223796 A1 Jul. 10, 2025

(51) Int. Cl.

| | |
|---|---|
| ***E04B 1/98*** | (2006.01) |
| ***E04B 2/56*** | (2006.01) |
| ***E04H 9/02*** | (2006.01) |

(52) U.S. Cl.

CPC ..... *E04B 1/98* (2013.01); *E04B 2/56* (2013.01); *E04H 9/02* (2013.01)

(58) Field of Classification Search

CPC ..... E04B 2001/2496; E04B 2001/2696; E04B 1/98; E04B 2/56; E04H 9/02

See application file for complete search history.

(56) References Cited

U.S. PATENT DOCUMENTS

| | | | | |
|---|---|---|---|---|
| 3,568,388 | A * | 3/1971 | Flachbarth | E04B 2/72 52/630 |
| 5,218,803 | A * | 6/1993 | Wright | E04B 2/767 52/243 |
| 5,619,837 | A * | 4/1997 | DiSanto | E04C 2/384 52/630 |
| 6,260,323 | B1 * | 7/2001 | Hockey | E04B 2/74 52/537 |
| 6,327,831 | B1 * | 12/2001 | Leek | E04B 1/2604 52/698 |
| 6,484,460 | B2 * | 11/2002 | VanHaitsma | E04B 1/0007 52/274 |
| 8,387,321 | B2 * | 3/2013 | diGirolamo | E04B 2/58 52/713 |
| 8,689,518 | B2 | 4/2014 | Gridley et al. | |
| 9,010,054 | B2 * | 4/2015 | Herdt | B29C 44/1214 52/783.17 |
| 9,340,977 | B2 * | 5/2016 | Nanayakkara | E04C 3/06 |

(Continued)

FOREIGN PATENT DOCUMENTS

| | | |
|---|---|---|
| CN | 110344432 | 10/2019 |
| CN | 110468993 | 11/2019 |

OTHER PUBLICATIONS

International Search Report and Written Opinion dated Mar. 21, 2025 in International Patent Application No. PCT/US2024/060965.

*Primary Examiner* — Paola Agudelo
(74) *Attorney, Agent, or Firm* — Pearl Cohen LLP

(57) ABSTRACT

A prefabricated shearwall includes a central panel having reinforcing stiffeners within side edges of the panel. The central panel is provided with one or more corrugations to withstand both vertical (gravitational) and lateral loads. The stiffeners in the side edges provide improved resistance to lateral loads and controllable yielding to dissipate shear stresses within the shearwall.

26 Claims, 19 Drawing Sheets

(56) References Cited

U.S. PATENT DOCUMENTS

| | | | | |
|---|---|---|---|---|
| 10,711,477 | B1 * | 7/2020 | Anderson | E04H 9/0237 |
| 2001/0002529 | A1 * | 6/2001 | Commins | E04B 1/26 52/514 |
| 2002/0066245 | A1 * | 6/2002 | Pryor | E04B 1/26 52/283 |
| 2003/0041551 | A1 * | 3/2003 | Boone | E04B 1/26 52/698 |
| 2005/0126105 | A1 * | 6/2005 | Leek | E04H 9/02 52/633 |
| 2006/0037256 | A1 * | 2/2006 | Pryor | F16B 15/0046 52/167.1 |
| 2006/0144008 | A1 * | 7/2006 | Fouch | E04B 1/26 52/292 |
| 2017/0306621 | A1 * | 10/2017 | Laursen | E04F 13/0876 |
| 2020/0002934 | A1 * | 1/2020 | McCarron | E04B 1/2403 |
| 2021/0180315 | A1 * | 6/2021 | Marshall | E04B 2/7407 |
| 2021/0238850 | A1 * | 8/2021 | Baily | E04C 2/386 |

* cited by examiner (Line 3B-3B)

CORRUGATED SHEARWALL

BACKGROUND

Field of the Technology

The present technology relates to a shearwall for opposing lateral forces on building walls, and in particular to a prefabricated shearwall including a central panel having a corrugated or non-planar cross section to improve the ability of the shearwall to withstand lateral forces such as those generated in earthquakes, high winds, floods and snow loads.

Description of the Related Art

Shearwalls were developed to counteract the potentially devastating effects of natural phenomena such as seismic activity, high winds, floods and snow loads on the structural integrity of light-framed constructions. Prior to shearwalls and lateral bracing systems, lateral forces generated during these natural phenomena often caused the top portion of a wall to move laterally with respect to the bottom portion of the wall, which movement could result in structural failure of the wall and, in some instances, collapse of the building. Shearwalls within wall sections of constructions provide lateral stability and allow the lateral forces in the wall sections to be transmitted through the shearwalls between the upper portions of the wall and the floor panel or foundation of the building where they are dissipated without structural effect on the wall or building.

In constructions such as residences and small buildings, a lateral bracing system typically includes vertical studs spaced from each other and affixed to horizontal top and base plates. The base plate is typically anchored to the floor panel or foundation. The bracing system typically further includes sheathing affixed to the studs, upper plate and/or lower plate to increase structural response to lateral forces. The sheathing used is generally oriented strand board (OSB) or plywood, but fiberboard, particleboard and drywall (gypsum board) are also used. Alternatively or additionally, construction wall sections may include prefabricated shearwall sections, which can be positioned between the vertical studs and affixed to the studs and the top and bottom connecting plates. The sheathing or prefabricated panels can also be placed adjacent door and window frames to improve the response to lateral forces at these locations.

A conventional prefabricated shearwall 20 is shown in the perspective and cross-sectional views in FIGS. 1 and 2. The shearwall includes an interior panel 22 formed of thin gauge sheet steel. The panel is conventionally planar with the edges 26 and 28 along the length of the panel being formed by respective lips 30 and 32. The edges 26 and 28 (orthogonal to interior panel 22 and lips 30, 32) allow the panel to be affixed to the surrounding wooden framing members.

While a prefabricated shearwall of the construction shown in FIGS. 1 and 2 provides lateral force response and resistance, it has limitations with respect to its lateral load bearing capabilities. There is, therefore, a need for an improved shearwall capable of withstanding greater lateral loads.

SUMMARY OF THE TECHNOLOGY

The present technology relates to a prefabricated shearwall, including a central panel, having a height generally defined by top and bottom edges, and a width generally defined by a pair of edge sections. The panel further includes at least one corrugation extending in the height direction between the top and bottom edges. The corrugation increases the cross-sectional area to withstand vertical loads, and increases the section modulus of the panel in the lateral direction to increase the resistance of the shearwall to lateral forces. In embodiments, the shearwall may further include a pair of reinforcing stiffeners affixed within the edge sections of the central panel. The stiffeners further improve the resistance of the shearwall to lateral forces, and have a configuration that provides controlled and defined yield locations of the shearwall.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

DETAILED DESCRIPTION

The present technology will now be described with reference to the figures, which in embodiments relate to a prefabricated shearwall panel including a central panel having reinforcing stiffeners within side edges of the panel. The central panel is provided with one or more corrugations to withstand both vertical (gravitational) and lateral loads. The stiffeners in the side edges provide improved resistance to lateral loads and controllable yielding to dissipate shear stresses within the shearwall.

It is understood that the present technology may be embodied in many different forms and should not be construed as being limited to the embodiments set forth herein; rather these embodiments are provided so that this disclosure will be thorough and complete and will fully convey the technology to those skilled in the art. Indeed, the technology is intended to cover alternatives, modifications and equivalents of these embodiments, which are included within the scope and spirit of the technology as defined by the appended claims. Furthermore, in the following detailed description of the present technology, numerous specific details are set forth in order to provide a thorough understanding of the present technology. However, it will be clear to those of ordinary skill in the art that the present technology may be practiced without such specific details.

The terms "top" and "bottom," "upper" and "lower" and "vertical" and "horizontal," and forms thereof, as may be used herein are by way of example and illustrative purposes only, and are not meant to limit the description of the technology inasmuch as the referenced item can be exchanged in position and orientation. Also, as used herein, the terms "substantially" and/or "about" mean that the specified dimension or parameter may be varied within an acceptable manufacturing tolerance for a given application. In one embodiment, the acceptable manufacturing tolerance is ±0.15 mm, or alternatively, ±2.5% of a given dimension.

For purposes of this disclosure, a connection may be a direct connection or an indirect connection (e.g., via one or more other parts). In some cases, when a first element is referred to as being connected, affixed, mounted or coupled to a second element, the first and second elements may be directly connected, affixed, mounted or coupled to each other or indirectly connected, affixed, mounted or coupled to each other. When a first element is referred to as being directly connected, affixed, mounted or coupled to a second element, then there are no intervening elements between the first and second elements (other than possibly an adhesive or melted metal used to connect, affix, mount or couple the first and second elements).

Figure 1:
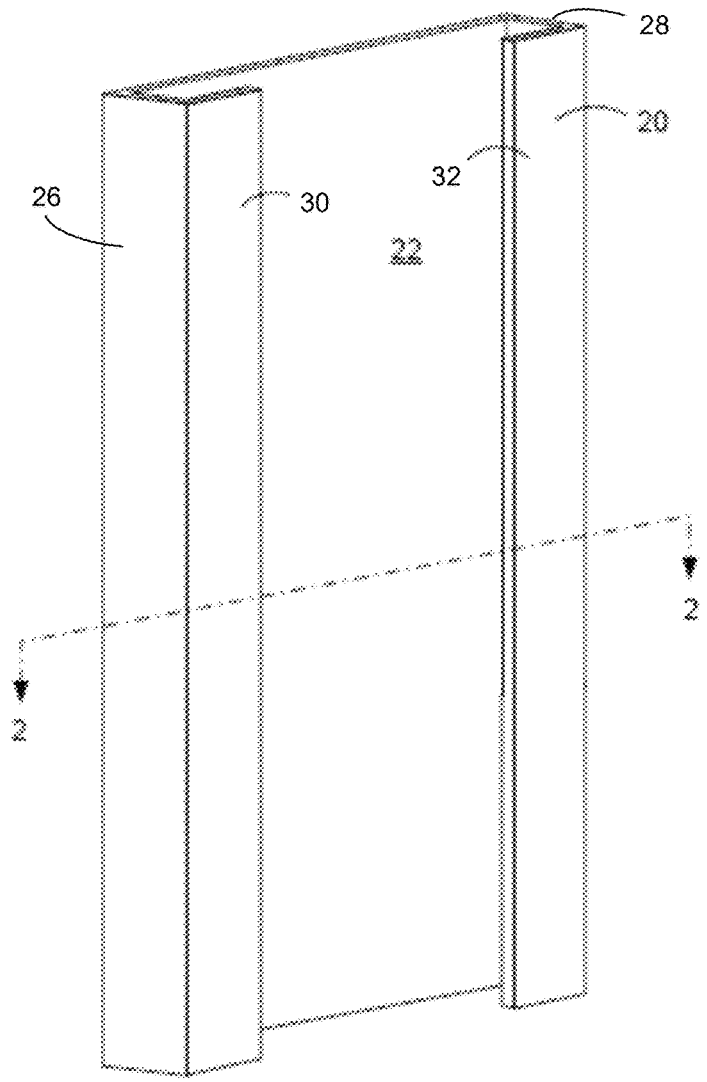
FIG. 1 (Prior Art)
FIG. 1 is a perspective view of a prefabricated shearwall panel according to the prior art.
Figure 2:
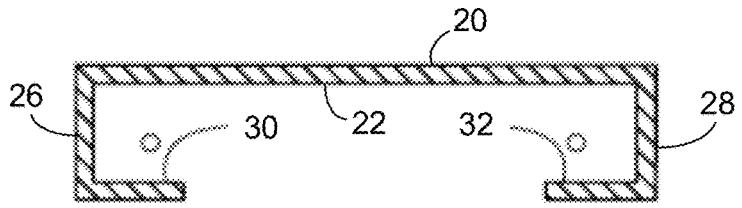
FIG. 2 (Prior Art)
FIG. 2 is a cross-sectional view through line 2-2 of FIG. 1 showing the prefabricated shearwall panel according to the prior art.
Figure 3:
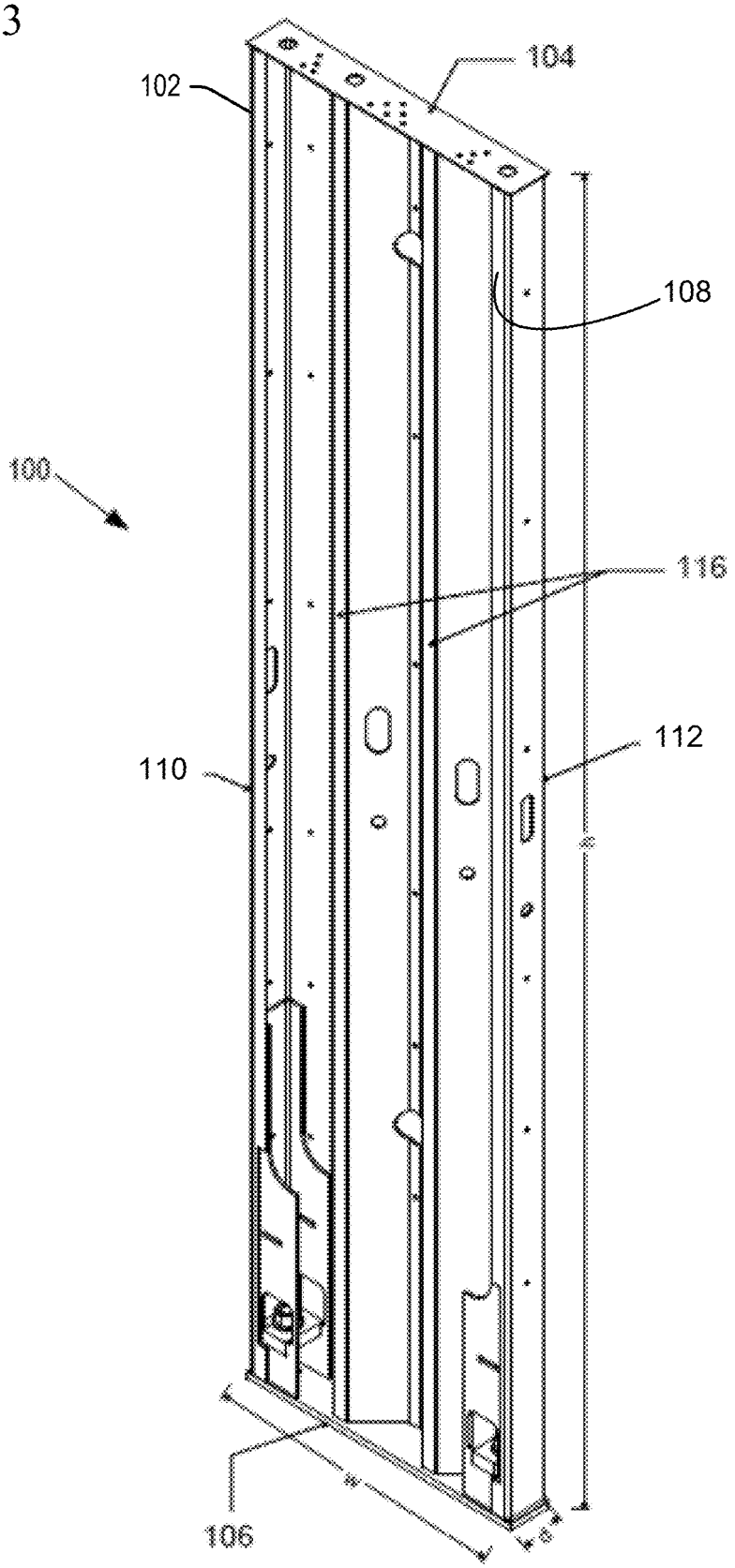
FIG. 3 is a perspective view of a prefabricated shearwall according to an embodiment of the present technology.
Figure 4:
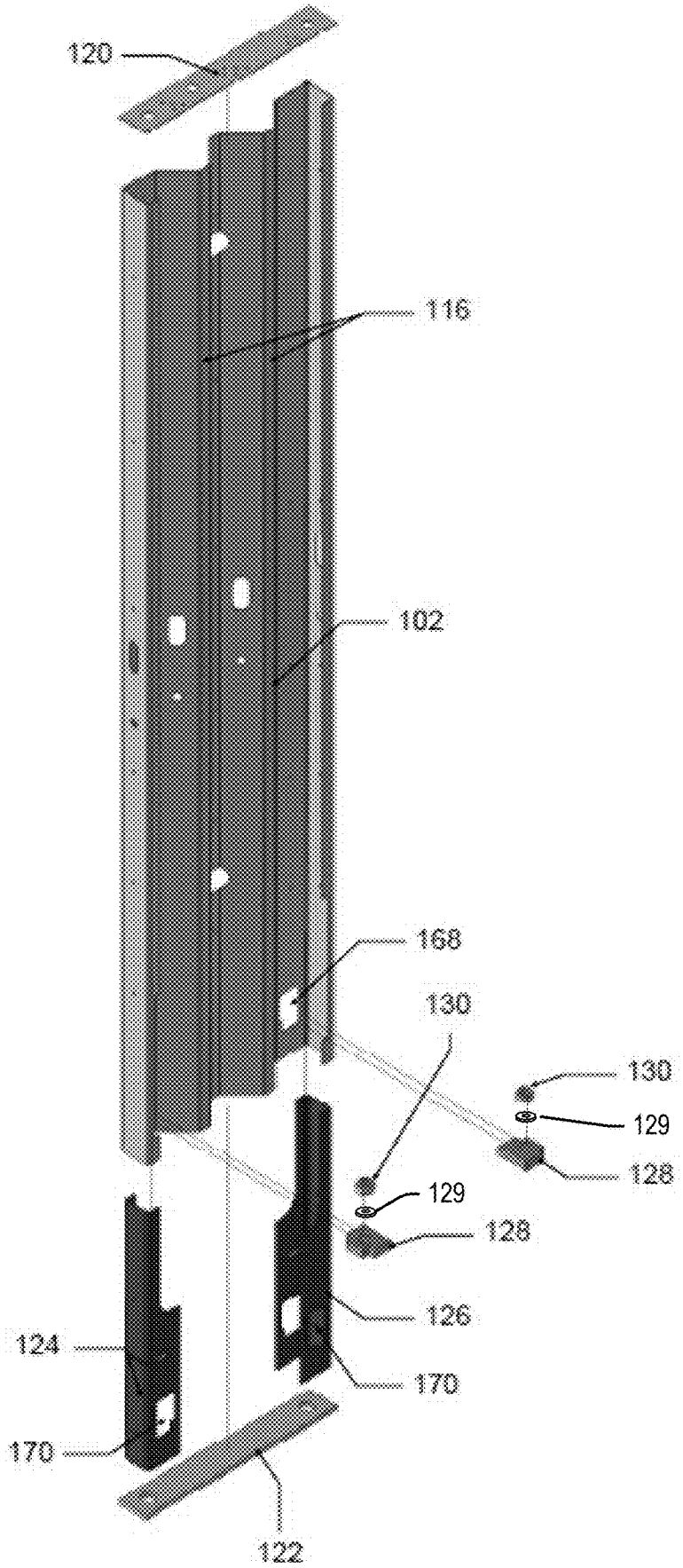
FIG. 4 is an exploded perspective view of the prefabricated shearwall according to the present technology.

FIG. 3 shows a perspective view of a prefabricated shearwall 100 according to embodiments of the present technology, and FIG. 4 shows an exploded perspective view of a prefabricated shearwall 100 according to embodiments of the present technology. The shearwall 100 has a height, width, and depth, each perpendicular to each other and denoted as h, w and d, respectively, in FIG. 3. In embodiments of the present technology, the shearwall 100 includes a top edge 104 and a bottom edge 106 generally defining the height of the shearwall, and a pair of left and right edge sections 110 and 112 generally defining the width of the shearwall. In embodiments of the present technology, the prefabricated shearwall 100 may have an overall height of 153¼ inches, an overall width of 24 inches, and a depth of 3½ inches. It is understood that each of these dimensions may be varied in alternative embodiments, both proportionately and disproportionately with respect to each other.

Referring now to the exploded perspective view of FIG. 4, the shearwall includes a central panel 102 that is covered on its top edge by top plate 120, and at its bottom edge by base plate 122. The top plate, base plate and central panel define the height of the shearwall as shown in FIG. 3. The top plate 120 and base plate 122 each has a length which is preferably at least equal to the width of the central panel 102, and a width at least equal to a depth of the central panel 102. The top and base plates are also rigid enough to allow even distribution of any localized compressive forces from the shearwall 100. In one embodiment of the present technology, the top and base plates may each be formed of 10 gauge and ½ inch thick steel respectively, though the thicknesses of one or both of these may vary in further embodiments. The top and base plates may be affixed to the central panel 102 by welding, though other affixation means such as bolting and gluing are possible instead of or in addition to welding.

As shown in FIGS. 3-4, the central panel 102 further includes a backplane 108 and one or more corrugations 116 (two shown in FIGS. 3-4) formed in a central portion of the panel and extending from the backplane 108. In embodiments, the corrugations may have a constant cross section from top edge 104 to bottom edge 106, but the corrugations may taper, bottom to top or top to bottom, in further embodiments. While the corrugations 116 are shown comprised of planar sections joined at angles with respect to each other, it is understood that the corrugation 116 may have different configurations in alternative embodiments. As used herein, a corrugation may be any ridge, groove or angle formed in central panel 102 extending out of plane in the depth dimension. In addition to adding increased resistance to gravitational and compressive loads (i.e., those parallel to the panel height, h), the corrugations 116 increases the section modulus and the ability of shearwall 100 to withstand lateral forces (i.e., those parallel to the panel width, w).

Moreover, the corrugations 116 provide increased strength and stiffness to the shearwall in the lateral direction.

In embodiments of the present technology, the central panel 102 may be formed of a single piece of material bent to include the corrugations 116 and edge sections 110, 112. However, in further embodiments, the central panel 102 could be formed of multiple pieces attached to each other as by welding or bolting. In embodiments, the central panel 102 may be formed of 10-gauge steel (0.1345 inches). Other gauges, such as for example 7-gauge steel, and other materials of comparable strength and rigidity may be used in alternative embodiments.

In embodiments, the corrugation(s) 116 may extend out of the plane of the rear of shearwall 100 the entire depth of the shearwall 100. One or more of the corrugation(s) 116 need not extend the entire depth of the shearwall in alternative embodiments.

Some conventional shearwalls were built with wooden chords at the edges of the shearwall, such as disclosed in U.S. Pat. No. 82,281,551 to Simpson Strong-Tie Company, Inc., entitled "Corrugated Shearwall," which patent is incorporated herein in its entirety. Such chords are omitted in the shearwall of the present technology, with the result that the net width of the corrugated central panel 102 may extend to the edges of the base plate 122, thereby maximizing the assembly bending stiffness. However, as set forth below, chords may be included in further embodiments.

Figure 3A:
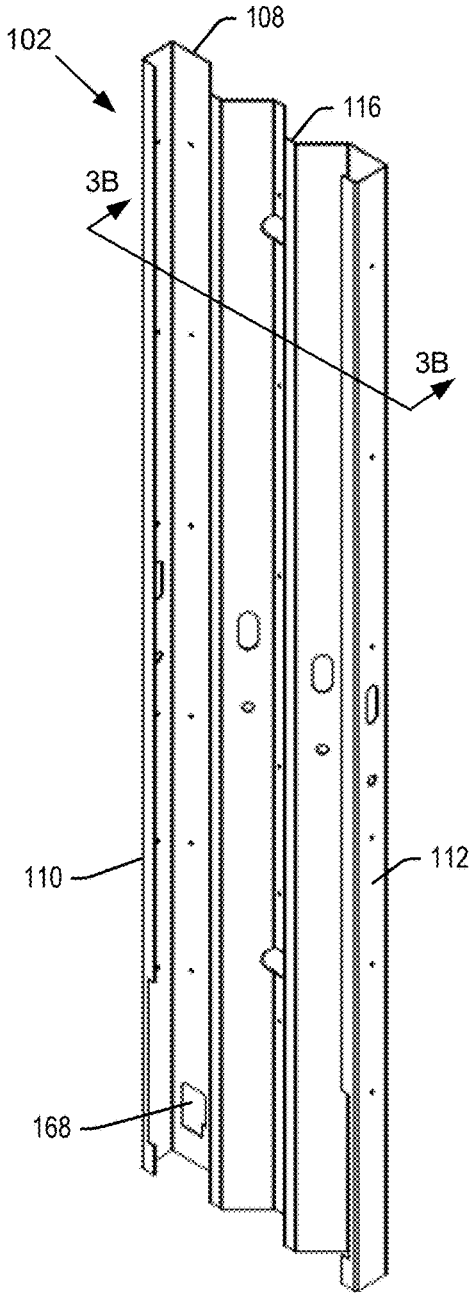
FIG. 3A is a perspective view of a central panel of the prefabricated shearwall according to embodiments of the present technology.
Figure 3B:
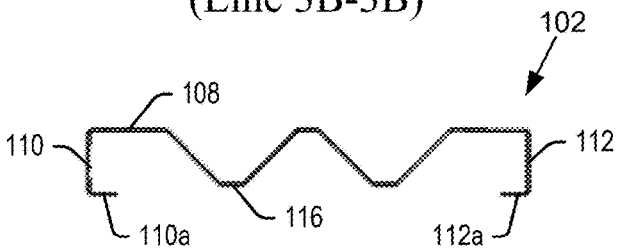
FIG. 3B is a cross-sectional view of the central panel through line 3B-3B of FIG. 3A.
Figure 3C:
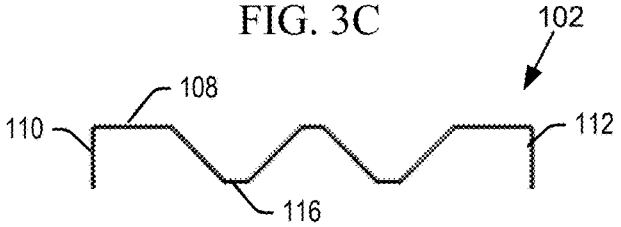
FIGS. 3C-3D are cross-sectional views of the central panel according to alternative embodiments of the present technology.
Figure 3D:
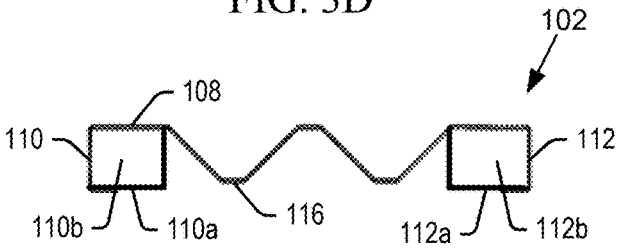

FIG. 3A is a perspective view of the central panel 102, and FIG. 3B is a cross-sectional view through line 3B-3B in FIG. 3A. FIG. 3A shows the corrugations 116, as well as left and right edges 110, 112. In embodiments, the lips 110*a*, 112*a* may extend orthogonally from edges 110, 112. FIG. 3A further shows one embodiment of lips 110*a* and 112*a*, which extend inward from edges 110 and 112, respectively, toward a central longitudinal axis of the central panel 102. In a further embodiment shown in the cross-sectional view of FIG. 3C, lips 110*a* and 112*a* may be omitted. In a further embodiment shown in the cross-sectional view of FIG. 3D, the lips 110*a* and 112*a* may extend inward and then bend toward backplane 108 to define enclosed spaces 110*b* and 112*b*. The lips 110*a*, 112*a* of FIGS. 3B and 3D may be formed integrally with edge sections 110, 112, or they may be welded to edge sections 110, 112 in further embodiments. Further configurations of the edge sections 110, 112 are possible. Other features of the central panel 102 include holes in the corrugation 116 and edge sections 110 and 112 for plumbing and electricity conduits runs.

Embodiments of the central panel 102 may include anchor access openings 168 shown for example in FIGS. 3A and 4. The access openings 168 allow the anchor bolts 180, discussed below, to be tightened from either side of the installed shearwall 100. The access openings 168 do not need to be present in further embodiments.

In accordance with further aspects of the present technology, the shearwall 100 of the present technology also includes a pair of internal stiffeners 124 and 126. The internal stiffeners 124, 126 are shown separate from the shearwall in the exploded perspective view of FIG. 4 and the enlarged exploded perspective view of FIG. 5. The enlarged sectional view of FIG. 6 shows the stiffener 124 in its assembled position within an interior of edge section 110. The stiffener 126 is similarly positioned within the edge section 112 in its assembled position. Each edge section 110, 112 may have a cross-section sized and shaped so that the stiffeners 124, 126 fit within the edge sections 110, 112 with the edge sections surrounding the stiffeners 124, 126 on two, three or four sides. For example, the edge sections 110, 112 (and lips 110*a*, 112*a*) shown in the cross-sectional view of FIG. 3B surround the stiffeners 124, 126 on three sides. The edge sections 110, 112 shown in the cross-sectional view of FIG. 3C surround the stiffeners 124, 126 on two sides. And the edge sections 110, 112 (and lips 110*a*, 112*a*) shown in the cross-sectional view of FIG. 3D surround the stiffeners 124, 126 on four sides. In further embodiments, the stiffeners 124 126 may be oriented in other orientations such as 90 degrees or 180 degrees from what is shown in the figures.

As explained below, the panel 102 and stiffeners 124 and 126 are bolted to the foundation by a pair of anchor bolts, heavy bearing plate washers 128, "standard washers" 129, and heavy hex nuts 130. The edge sections 110, 112 of the central panel 102 are affixed to the stiffeners 124, 126 by welds 136 ("top welds") shown for example in FIG. 6. The stiffeners 124, 126 are also affixed to the base plate by welds 137 ("base plate welds"). In addition to welding at the front surface as shown in FIG. 6, welds may be formed between the stiffeners and edge sections at the backplane 108 and side edges of the shearwall 100. The edge sections 110, 112 may be affixed to the stiffeners 124, 126 by other methods including bolting and gluing instead of or in addition to welding.

Figure 7A:
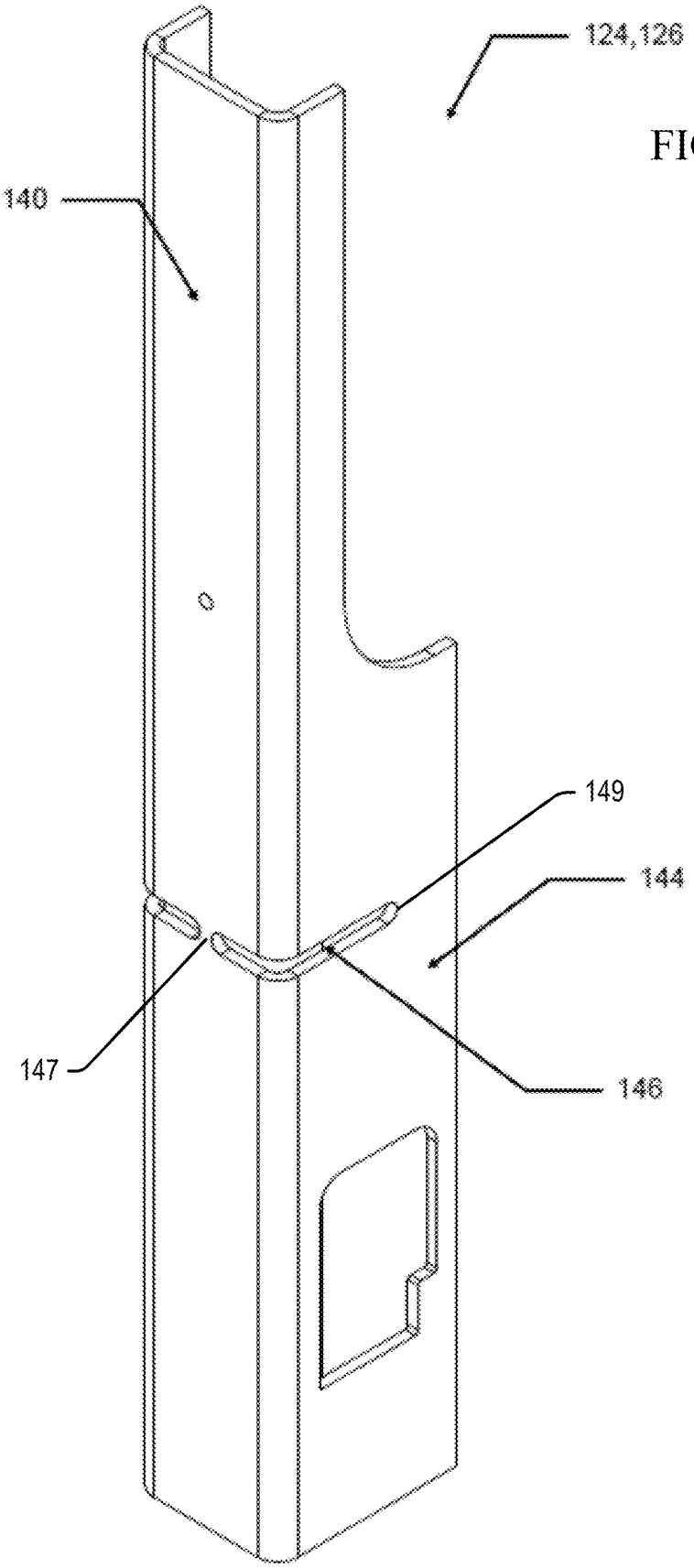
FIG. 7A is a perspective view of an internal stiffener of a shearwall according to an embodiment of the present technology.
Figure 7B:
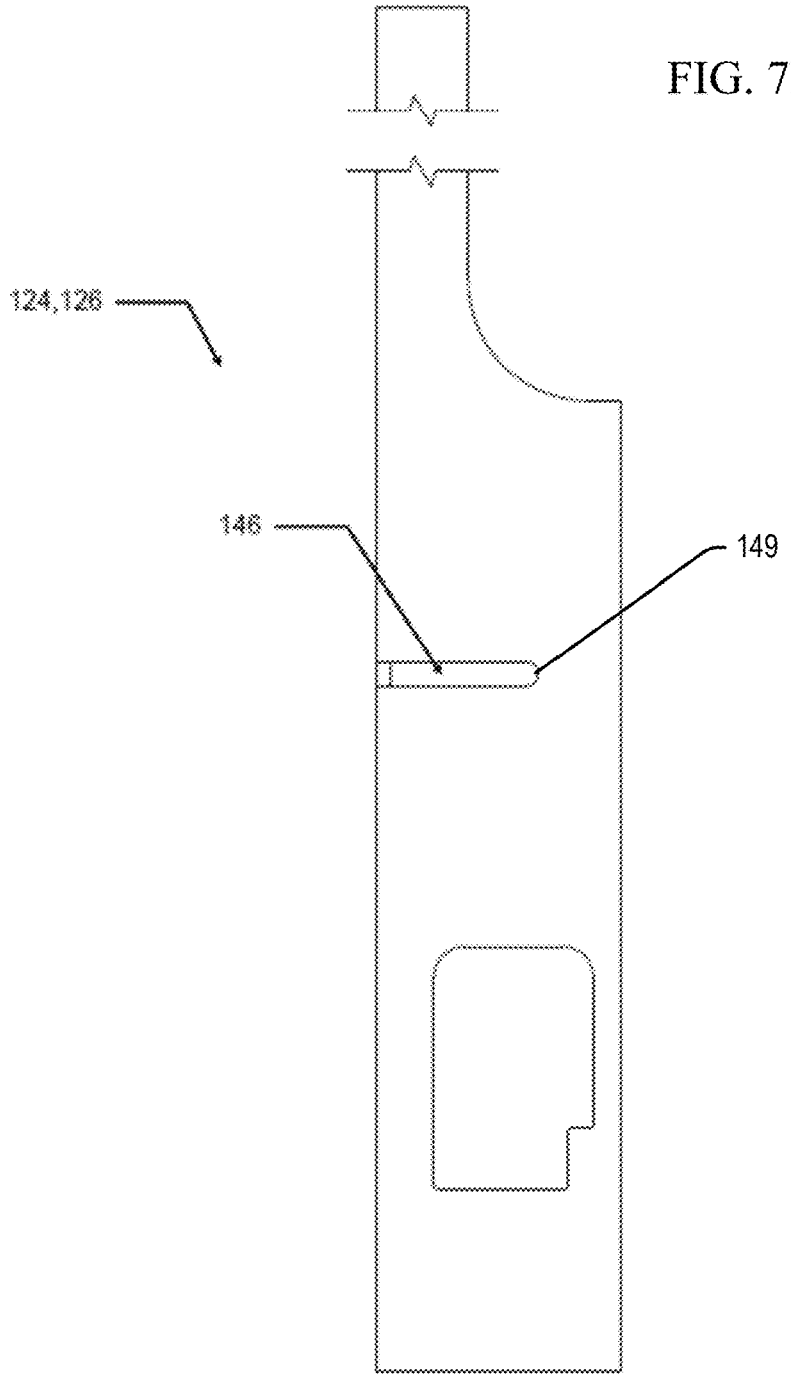
FIG. 7B is a side view of the internal stiffener shown in FIG. 7A.
Figure 7C:
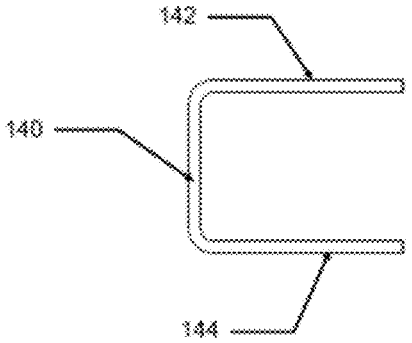
FIG. 7C is a cross-sectional view through the internal stiffener shown in FIG. 7A.

FIGS. 7A, 7B and 7C illustrate perspective, side and cross-sectional views, respectively, of one of the stiffeners 124, 126. In one embodiment, each stiffener 124, 126 includes an elongated back portion 140, and respective side portions 142, 144 to form a C-shape in cross-section (FIG. 7C). In one embodiment, the elongated back portion 140 may have a length of 28 inches and the side portions 142, 144 may have a length of 16 inches. These dimensions may vary in further embodiments. The cross-sectional footprint of the stiffeners 124, 126 may be provided so that each fits snugly within the edge sections 110, 112.

The internal stiffeners 124, 126 are provided with slots 146, oriented transverse to their length, provided at locations along their length. FIGS. 7A and 7B show one such slot 146, but there may be more slots along the length of each internal stiffener 124, 126 in further embodiments. In one embodiment having a single slot, the slot may be provided 11½ inches from a bottom of the stiffener. This dimension may vary in alternative embodiments. In a further embodiment shown in FIGS. 8A-8B, there may be two slots 146 along the length of each stiffener 124, 126. In such embodiments, the lower slot may be provided 12 9/16 inches from a bottom of the stiffener, and the upper slot may be provided 18 9/16 inches from the bottom of the stiffener. Both of these dimensions may vary in further embodiments. Each slot may for example be 7/16 inches wide, though again this dimension may vary in further embodiments. The length of the slots 146 on the side portions 142 144 may be defined to create a rotation point as explained below. In one embodiment, the slot length may be 2 11/16 inches long but may vary in future embodiments. The stiffeners 124, 126 may be formed of 3 gauge steel (0.2391 inches), though they may be other thicknesses in further embodiments such as for example 7 gauge steel.

Figure 8A:
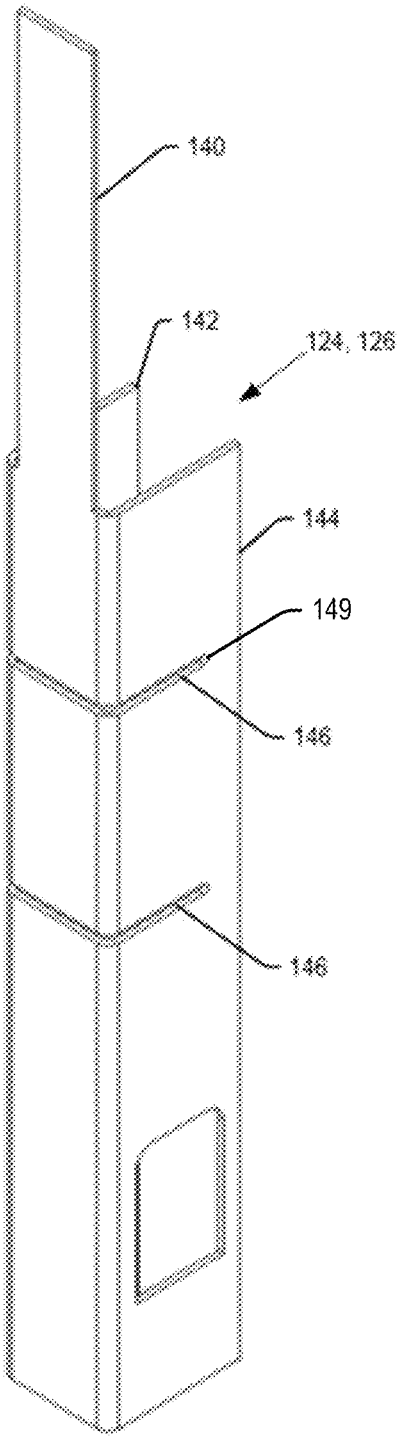
FIG. 8A is a perspective view of an internal stiffener of a shearwall according to an alternative embodiment of the present technology.
Figure 8B:
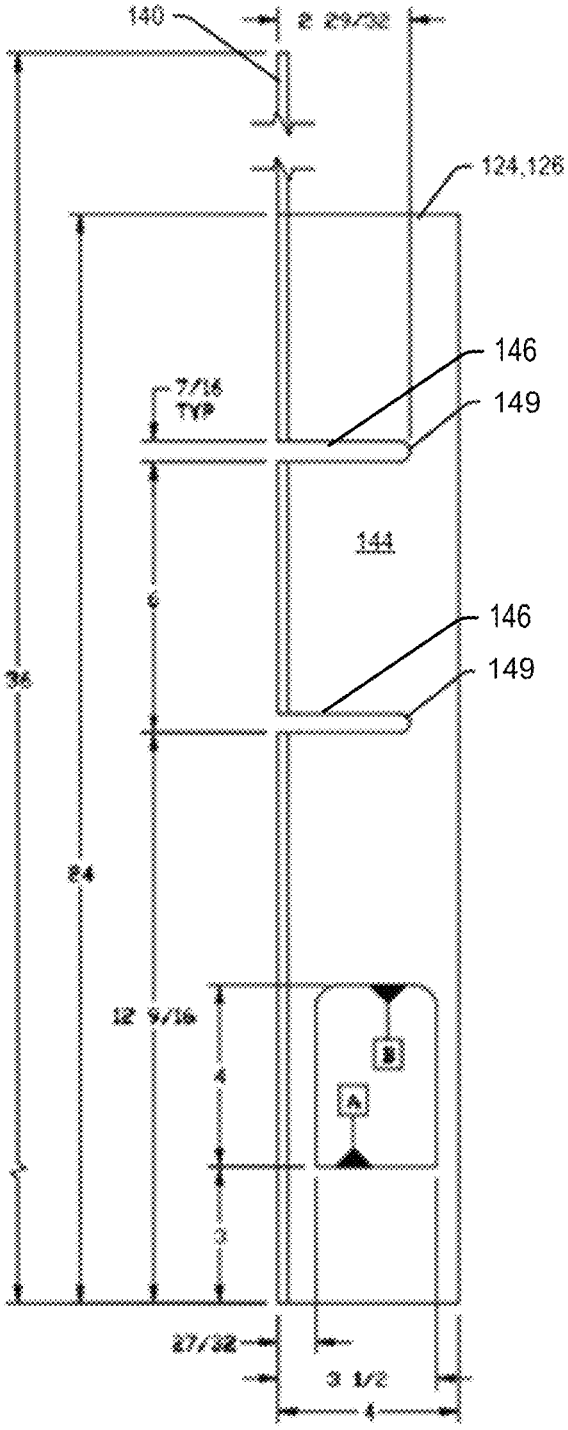
FIG. 8B is a side view of the internal stiffener shown in FIG. 8A.

In some embodiments, the slots 146 in stiffeners 124, 126 may have an opening of constant gap diameter along the entire slot (FIGS. 8A and 8B). However, in further embodiments, one or more of the slots 146 in stiffeners 124, 126 may be interrupted with a tab extending across the slot. Such a tab, referred to herein as slot fuse tab 147, is shown for example in FIG. 7A. The slot fuse tab 147 may be provided on the back portion 140 of each stiffener and may extend transversely across the length of the slot 146. In one embodiment, the slot fuse tab may be ¼ inch wide but may vary in other embodiments. FIG. 7A shows a single slot fuse tab along the length of slot 146, but there may be more than one slot fuse tabs 147 within each slot, or no slot fuse tab at all (FIGS. 8A and 8B). Where there are multiple slot fuse tabs 147 in a given slot, the tabs 147 may be in one or more of the back portion 140 and/or side portions 142, 144.

In the event of stresses on shearwall 100 above predefined limits, the stiffeners 124, 126 and the one or more slot fuse tabs 147 are configured so that the slot fuse tabs 147 are the initial yield point in stiffeners 124, 126. In embodiments, upon loads above a predefined level, the slot fuse tabs 147 may break, allowing the slot 146 to get wider or narrower to a greater degree.

The slots 146 each have an end in the side portions 142, 144. Those ends are referred to herein as rotational yield points 149. In the event of stresses on shearwall 100 above predefined limits, the stiffeners 124, 126 and the one or more slots 146 are configured so that the rotational yield points are the second yield point in stiffeners 124, 126 after the slot fuse tabs 147. The rotational yield points 149 may yield in tension (so that the slots 146 get wider) or in compression (so that the slots 146 get narrower).

Figure 9A:
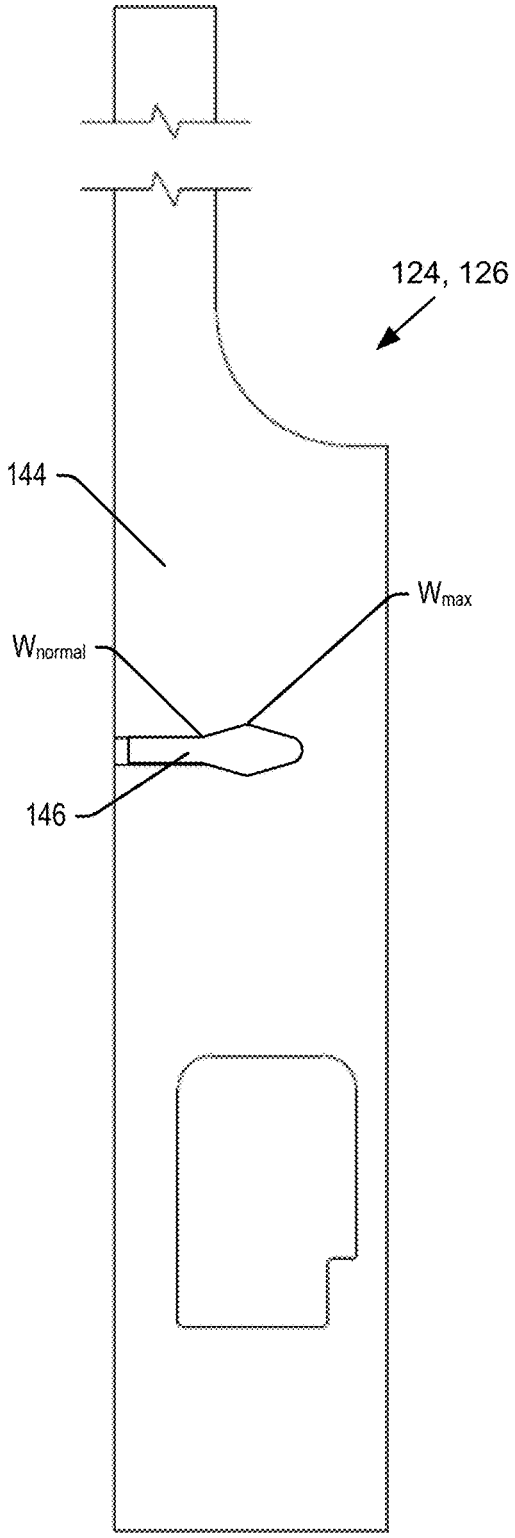
FIG. 9A is a perspective view of an internal stiffener of a shearwall according to a further alternative embodiment of the present technology.
Figure 9B:
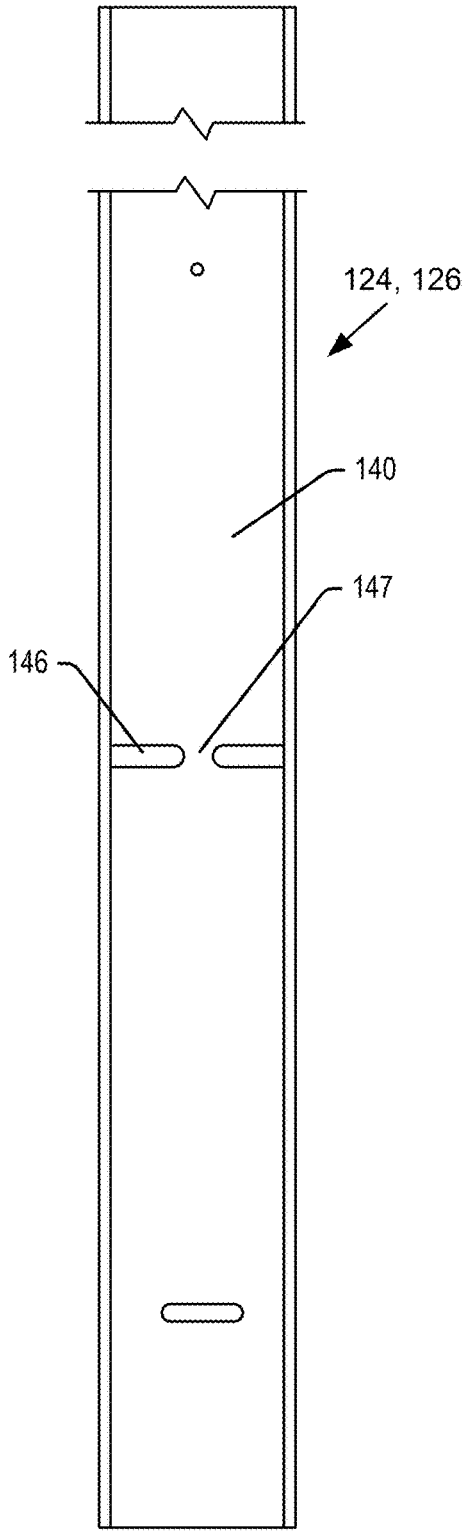
FIG. 9B is a front view of the internal stiffener shown in FIG. 9A.

As noted, in embodiments, each slot 146 may have a constant gap width along the length of the slot (as shown in FIGS. 8A and 8B). However, in a further embodiment, slot 146 may have a variable gap width along the length of the slot 146. In one such example, shown in side view and rear view in FIGS. 9A and 9B, the portion of the slot 146 adjacent the rotational yield points 149 may have a variable slot width. As shown the slot 146 may be narrow at the rotational yield point 149, and then gradually widen away from the rotational yield point 149. The slot gets wider until it reaches a maximum width at $W_{max}$. From there, the slot may get gradually narrower away from the rotational yield point 149 until it reaches a point, $W_{normal}$, which is the normal width of the slot 146. In embodiments, the length of the variable width portion of the slot 146 (from rotational yield point 149 to $W_{normal}$ may be 1.25 inches, and the width of the slot at $W_{max}$ may be ¾ inches wide. As noted above, the normal width of the slot, $W_{normal}$ may be 7/16 inches wide. Each of these dimensions may vary in further embodiments, both proportionately and disproportionately to each other. Finite element analysis shows that a slot 146 with a variable gap width at the end of the slot reduces stress on the material, and increases the ductility of the material, at the rotational yield points 149. This therefore increases the ductility of the shearwall 100.

The internal stiffeners 124, 126 provide several advantages to shearwall 100. Welded or otherwise affixed to the edge sections 110, 112, and the base plate 122, the internal stiffeners increase the section modulus of shearwall 100 creating a stiff composite section effective at withstanding lateral loads below some predefined and controlled threshold. At this predetermined threshold, the stiffeners 124, 126 mitigate exterior and interior buckling at the edge sections 110, 112 near the base of shearwall 100, where flexural stresses are the highest.

The stiffeners 124, 126 each further include a configuration which facilitates controlled yielding of the shearwall 100 above the predefined and controlled lateral load threshold to effectively dissipate energy from lateral loads. In particular, the slot fuse tabs 147 of the internal stiffeners 124 126 have been proportioned according to lateral loads above the predefined threshold to act as a yielding element as the slots 146 compress or expand. Once the proportioning threshold of the slot fuse tab 147 is reached, the tabs may break as noted above, allowing the slots 146 to continue to compress or expand at a larger degree. Once the tabs 147 break, the load is redistributed to the rotational yield points 149 of the stiffeners 124 126 to dissipate the energy caused by lateral loading.

As noted above, the stiffeners 124, 126 are affixed to the edge sections 110, 112 as by welding, for example by welds 136 and 137 shown in FIG. 6. The front and back welds 136 may for example be 2¾ inches and 8 inches from a bottom of shearwall 100 to create a fully composite section near base of the shearwall 100. Additionally, the front and back welds "top welds" may for example be 10 inches from the top of the stiffeners 124, 126. In embodiments, the positions of the welds along the length of the shearwall do not align with the slots 146. Thus, the panel 102 is not locked (welded) to the stiffeners 124, 126 at the slots 146 so that the edge sections 110, 112 may buckle at the yielding locations (the slot fuse tabs 147 and rotational yield points 149 of the stiffeners 124, 126).

As noted above, the stiffeners are affixed to the edge sections 110, 112 so that compression/expansion of the slots 146 will cause a corresponding buckling or expansion yielding of the panel 102 at the edge sections 110, 112, at longitudinal positions corresponding to the longitudinal positions of the slots 146. As shown in FIG. 6, the edge sections 110, 112, and in particular in lips 110*a*, 112*a*, may include cutout sections 132 which reduce the width of the lips 110*a*, 112*a* in the cutout sections 132. The cutout section 132 may be defined by a top edge 132*a* and a bottom edge 132*b*. The reduced width cutout section 132 provides a defined and controllable buckling location for the edge sections 110, 112 that align with the yielding mechanisms (slot fuse tabs 147 and rotational yield points 149) of the stiffeners 124 126.

Through features such as the slots 146, the slot fuse tabs 147, the rotational yield points 149, the reduced width cutout sections 132 and/or the welds 136, 137, buckling of the shearwall 100 is controlled to take place in edge sections 110, 112 at positions corresponding to one or both slots 146. This serves to provide a high degree of control over where the shearwall 100 yields. This also serves to dissipate energy under lateral loads and to improve the ductility of shearwall 100, while limiting damage elsewhere in the shearwall 100.

Figure 10A:
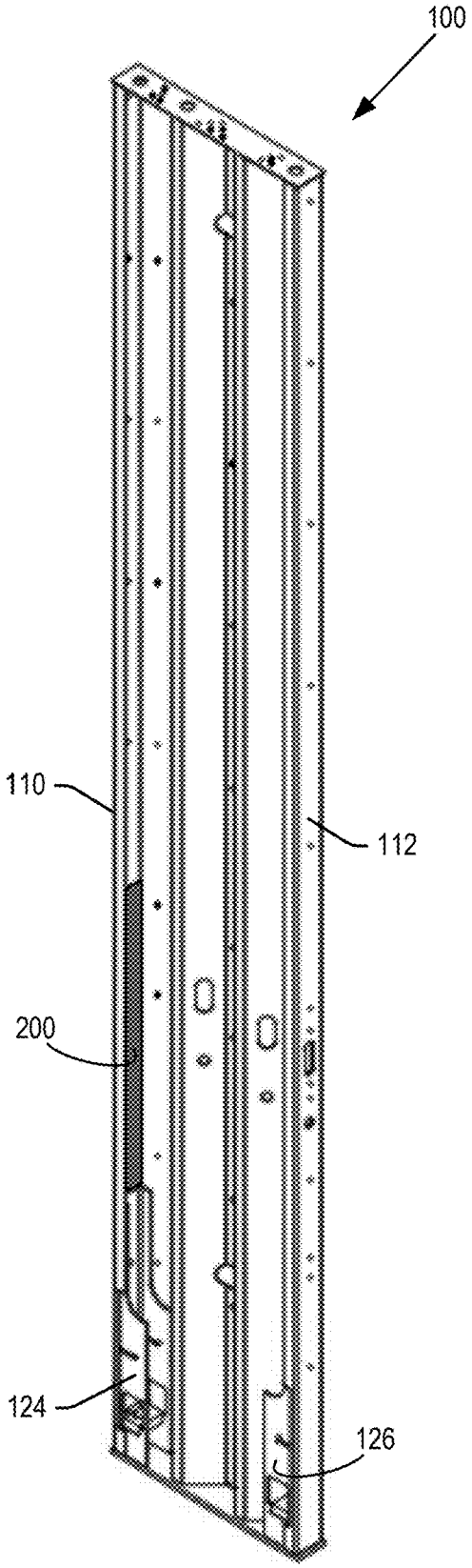
FIG. 10A is a perspective view of a shearwall according to an alternative embodiment of the present technology.
Figure 10B:
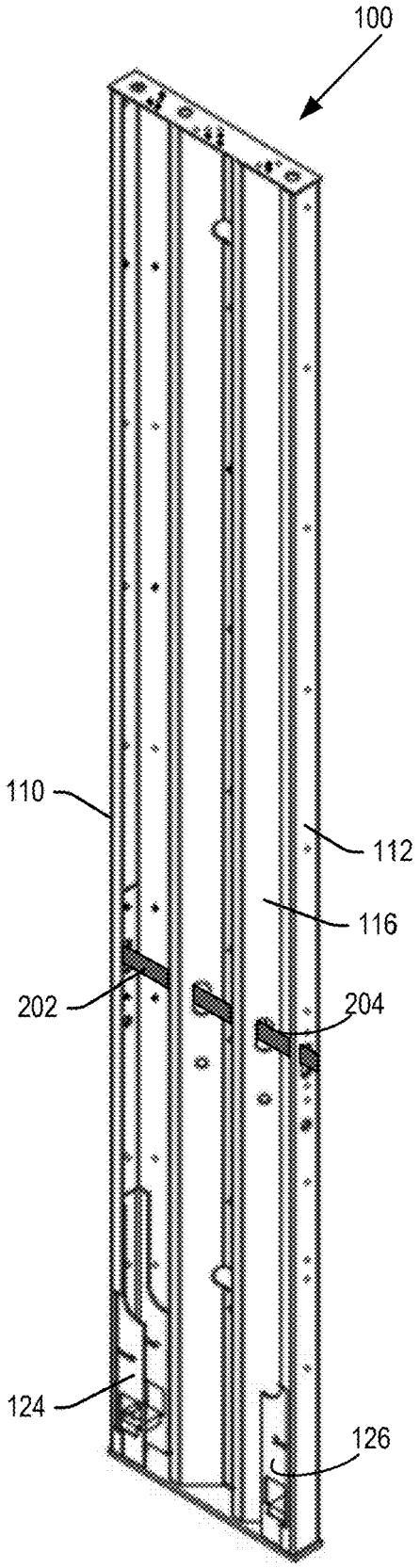
FIG. 10B is a perspective view of a shearwall according to another alternative embodiment of the present technology.
Figure 10C:
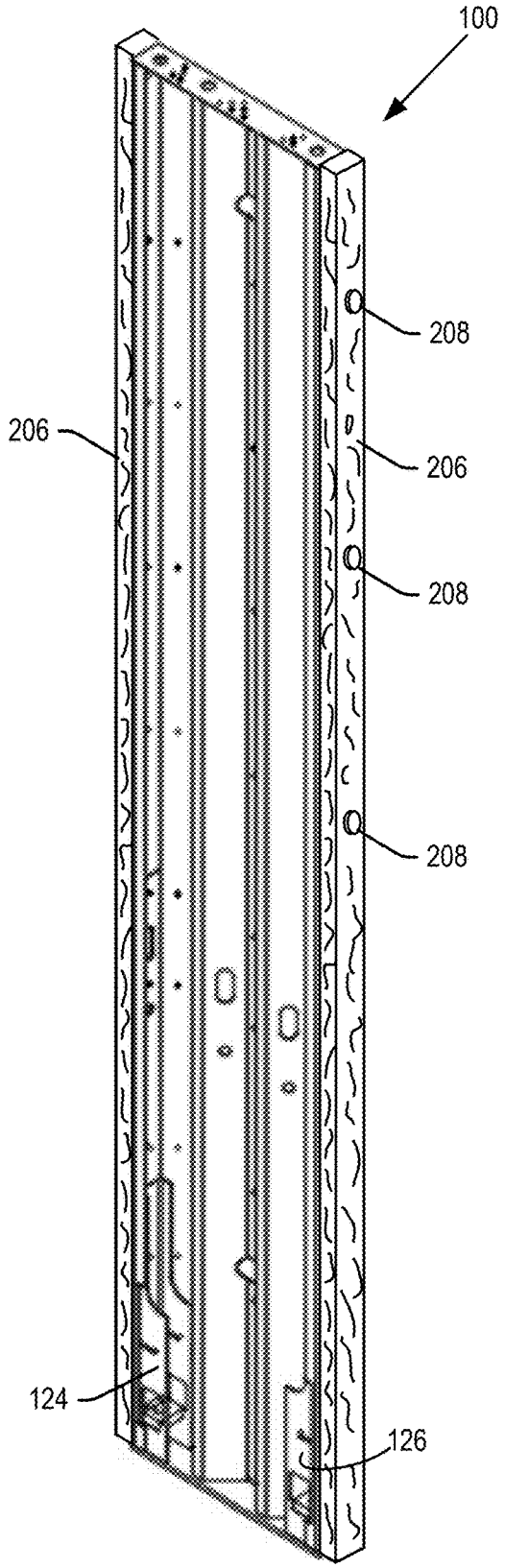
FIG. 10C is a perspective view of a shearwall according to a further alternative embodiment of the present technology.

It may happen that shear walls 100 that are of a certain height, for example taller than 9 or 10 feet require additional features to increase the torsional restraint of the shearwall 100 when resisting lateral loads. FIGS. 10A-10C illustrate three different ways to mitigate this. These methods may be used alone or in conjunction with each other. FIG. 10A illustrates a first method which is to weld a reinforcement plate 200 to the inside of the edge sections 110, 112 at critical locations, i.e., sections which undergo the greatest tortional loads, such as for example just above the stiffeners 124, 126. One such reinforcement plate 200 is shown in edge 110, but edge 112 may have a reinforcement plate 200 as well. The plate 200 may be of varying length, and there may be more than one such reinforcement plate 200 in each edge section 110, 112.

FIG. 10B illustrates a second method of increasing torsional restraint which is to weld a torsion strap 202 across the width of shearwall 100, from edge section 110 to edge section 112, at a critical location along the height of the shearwall 100. In the embodiment shown, the strap 202 may be fed through holes 204 in the corrugations 116. The strap may be formed of various materials including steel. While a single strap 202 is shown, there may be more than one strap 202 extending across the width of the shearwall 100 in further embodiments. Features may also be added to the torsional strap 202, such as bending one or both edges of the strap 202, to make it easier when field installers are supporting the weight of the shearwall.

FIG. 10C illustrates a third method of increasing torsional restraint which is to screw wood studs 206 to the outside faces of the edge sections 110, 112. The edge sections 110, 112 may include hole attachment locations along the height of the edge sections 110, 112 for receiving fasteners 208 through the wood studs 206 and edge sections 110, 112 to attach the wood studs to the shearwall 100. The hole attachment locations may be omitted from the bottom 20 inches of the shearwall 100 to allow the edge sections 110, 112 to buckle and dissipate the lateral load as described above. While these torsional restraints may be used in shearwalls than are for example 9 or 10 feet or taller as noted, one or more of these torsional restraints may be used for shorter shearwalls in further embodiments.

Figure 11A:
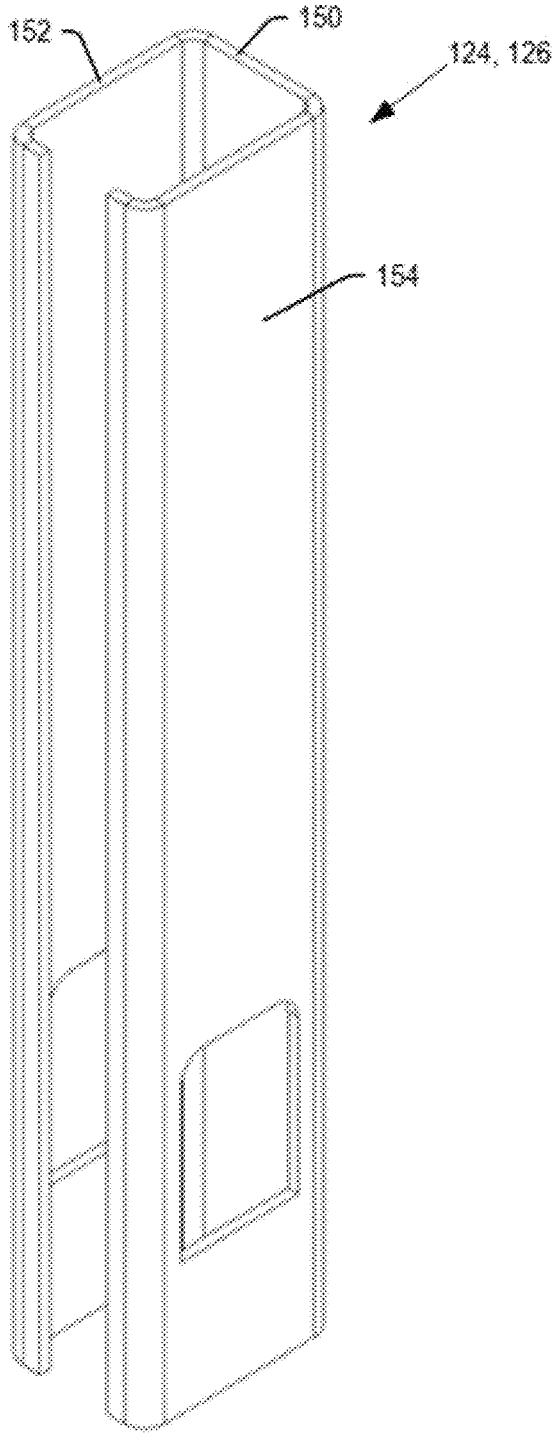
FIG. 11A is a perspective view of an internal stiffener of a shearwall according to another alternative embodiment of the present technology.
Figure 11B:
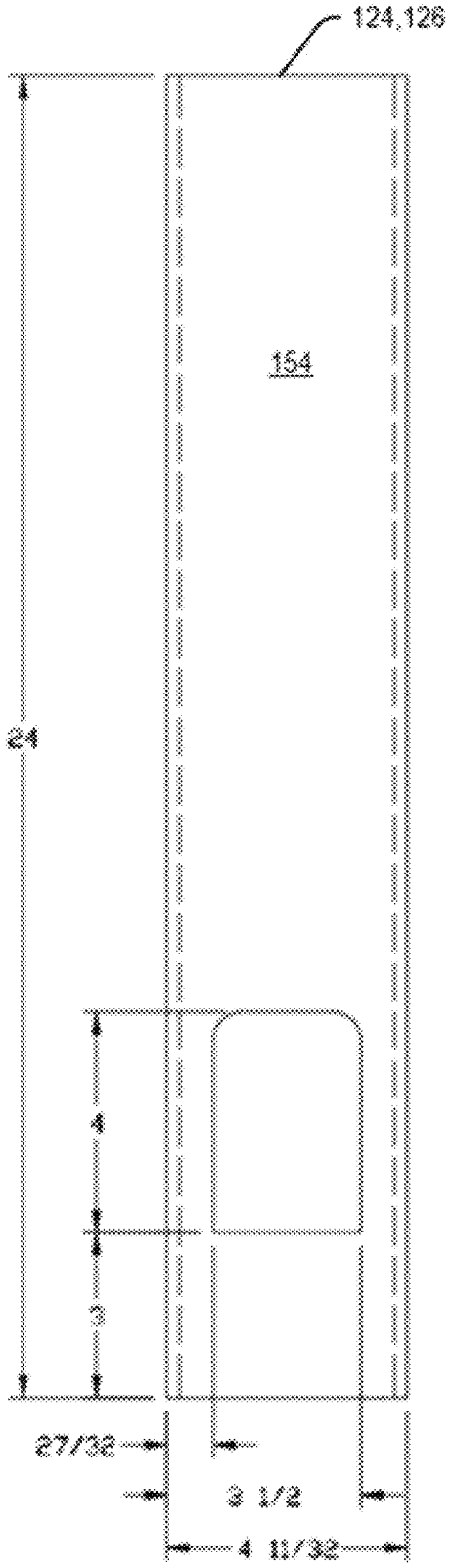
FIG. 11B is a side view of the internal stiffener shown in FIG. 11A.

It is understood that the stiffeners 124, 126 may have other configurations in further embodiments. For example, FIGS. 11A and 11B show perspective and side views of a further embodiment of the stiffeners 124, 126 where the slots 146 described above are omitted. This embodiment includes back portion 150, and respective side portions 152, 154 to form a C-shape in cross-section. While the slots 146 of stiffeners 124, 126 described above has advantages, it is understood that these slots may be omitted, with the stiffeners 124, 126 increasing the section modulus of shearwall 100 and mitigating exterior and interior buckling at the edge sections 110, 112 near the base of shearwall 100.

Figure 12A:
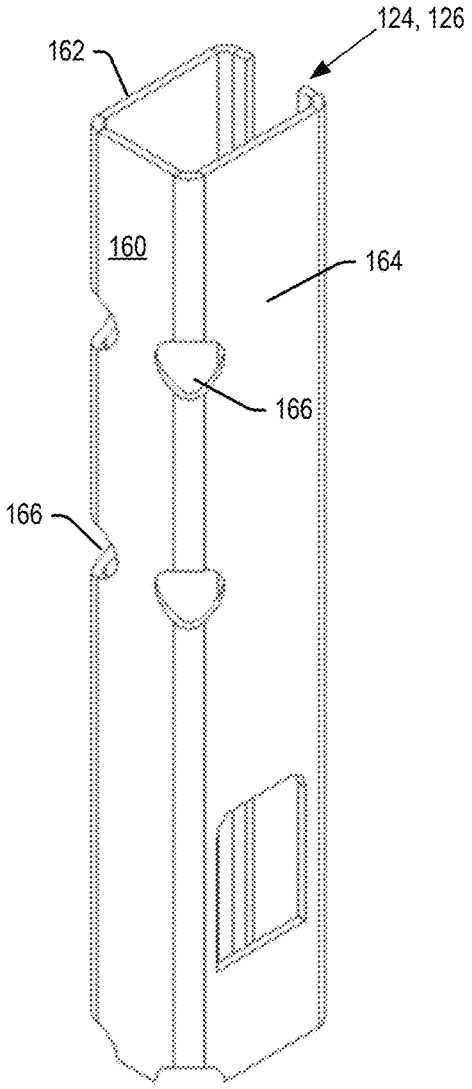
FIG. 12A is a perspective view of an internal stiffener of a shearwall according to a further alternative embodiment of the present technology.
Figure 12B:
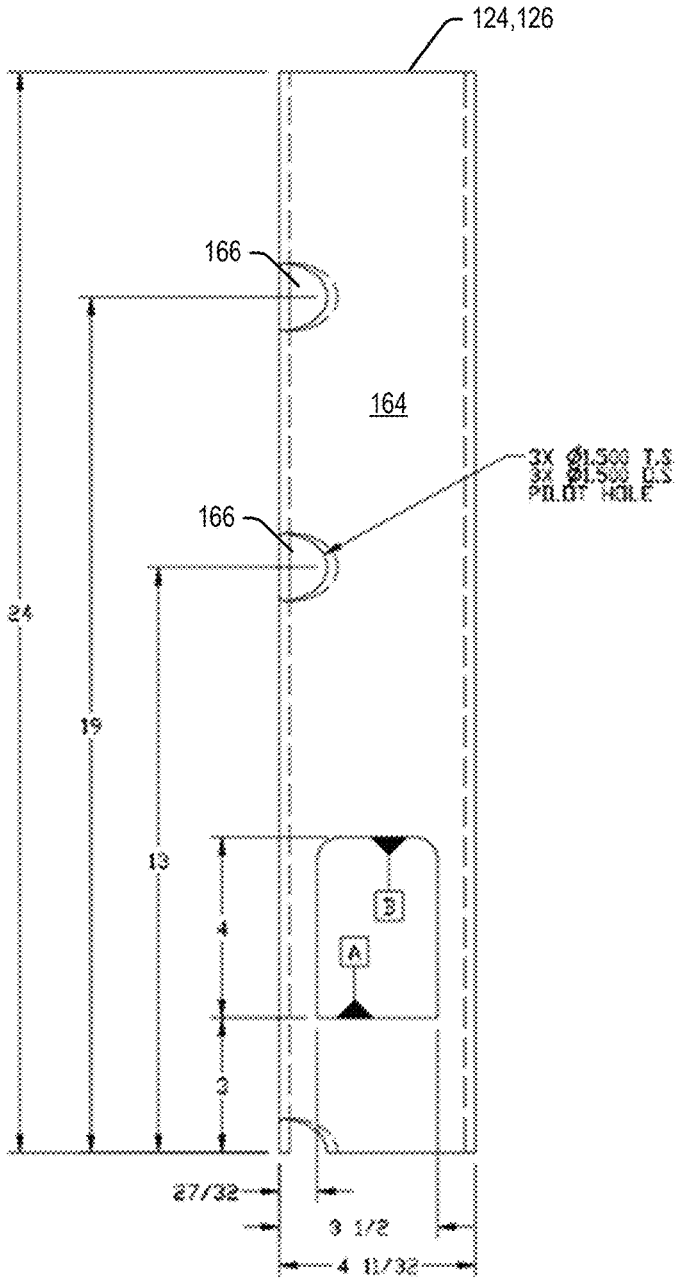
FIG. 12B is a side view of the internal stiffener shown n FIG. 12A.

FIGS. 12A and 12B show perspective and side views of a further embodiment of the stiffeners 124, 126. This embodiment includes back portion 160, and respective side portions 162, 164 to form a C-shape in cross-section. This embodiment further includes openings 166 provided along the length of stiffeners 124, 126. The openings 166 may be provided at corners where the back and side portions 160, 162, 164 come together. The openings 166 may further be provided completely within one or more of the back and side portions 160, 162, 164. The embodiment shown includes a first pair of openings 166 aligned with each other, and a second pair of openings 166 aligned with each other, along the length of stiffeners 124, 126. It is understood that the openings 166 need not be aligned with each other in further embodiments, and it is understood that there may be a single pair of openings 166 or more than two pairs of openings 166 in further embodiments.

As described above with respect to slots 146, the openings 166 shown in FIGS. 12A and 12B expand or contract upon lateral loads above some predefined threshold. Upon such expansion or contraction, the edge sections 110, 112 may expand or buckle at positions aligned with the openings 166.

Figure 13:
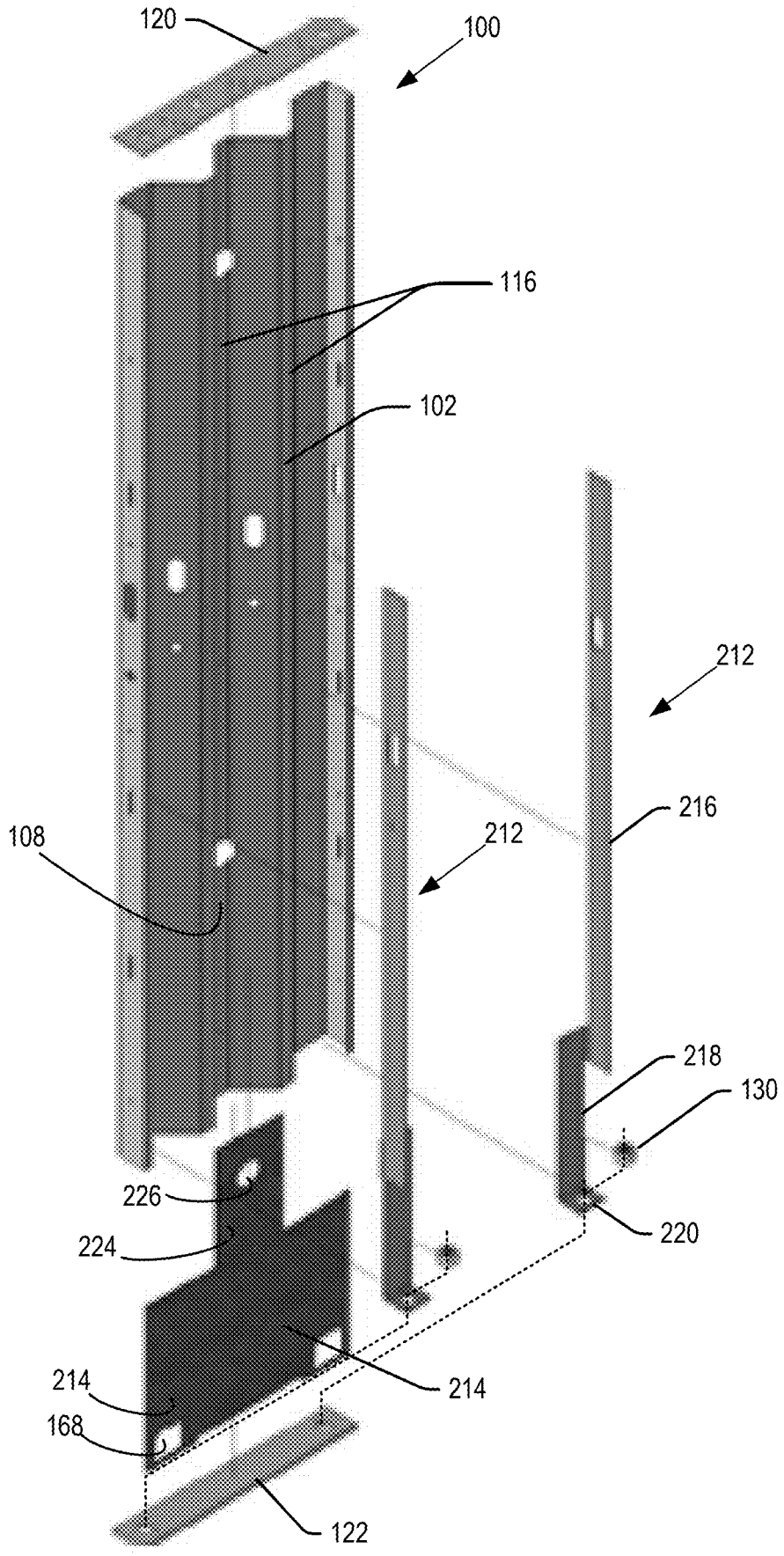
FIG. 13 is an exploded perspective view of a shearwall according to a further alternative embodiment of the present technology.

FIG. 13 shows a perspective view of a further embodiment where the stiffeners comprise a pair of L-shape stiffeners 212 and a cover plate 214 on the front side of the shearwall 100 to increases strength and stiffness. In this embodiment, each stiffener 212 may include a first, upper portion 216 comprising a flat plate oriented to fit against and affix to an interior surface of the edge sections 110, 112. Each stiffener 212 may further include a second portion 218, extending from the first portion 216, and rotated 90 degrees with respect to the first portion 216. The second portions 218 may be oriented to fit against (though not necessarily affixed to) the backplane 108 of the central panel 102. Each stiffener 212 may further include a third portion 220, extending from the second portion 218, and rotated 90 degrees with respect to the second portion 218. The third portions 220 may be oriented to fit against the base plate 122 and receive a bolt (not shown) and fasteners such as nut 130 as explained below.

The cover plate 214 includes a top portion 224 with an opening 226 to allow the top portion 224 to be bolted or otherwise affixed to the central panel 102, such as for example through at backplane 108. The cover plate further includes a pair of openings 168 for receiving a bearing plate washers as explained below.

Referring now for example to FIGS. 5, 6, 14 and 15, the shearwall 100 of the present technology may be bolted to the foundation by a pair of heavy bearing plate washers 128, a pair of standard washers 129, and a pair of heavy hex nuts 130. The bearing plate washers fit within a pair of openings 168 in the edge sections 110, 112 and a pair of openings 170 in the stiffeners 124, 126. When the stiffeners 124, 126 are positioned in the edge sections 110, 112 upon assembly, the openings 170 align with respective openings 168. In further embodiments, the openings 168, 170 may not be in pairs. In the present technology, the openings 168 170 are located offset from the base plate 122 allowing the anchor rod to elongate and compress under lateral loads. In other embodiments, the openings may be located at other locations, including at the base of the central panel 102.

Figure 14:
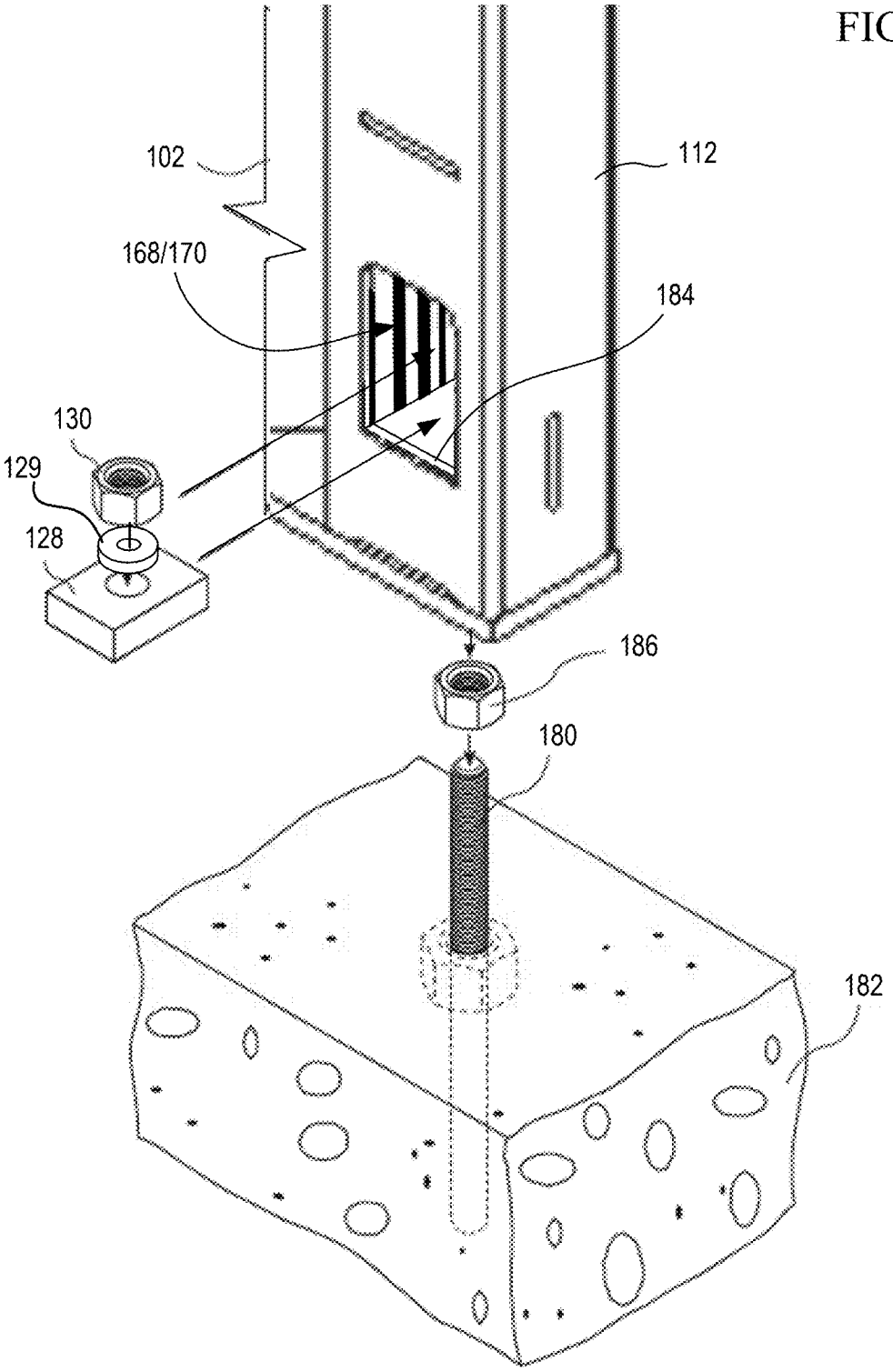
FIG. 14 is an exploded partial perspective view showing a portion of the shearwall of the present technology positioned on a foundation.

FIG. 14 is an exploded perspective view showing additional detail of one of the bearing plate washers 128, standard washer 129, and hex nuts 130 within one of the pair of openings 168, 170. The bearing plate washer 128 and hex nut 130 fit over an anchor bolt 180 which extends up into openings 168, 170 from beneath. The bearing plate washers 128 have enlarged holes to increase field installation tolerances and allow the shearwall 100 to be rotated up into place. The anchor bolt also extends down into the foundation 182 to secure the shearwall 100 to the foundation 182. As noted, the bearing plate washer 128 (on both sides of the central panel 102) extends through the openings 168, 170 in the pairs of edge sections/stiffeners. The ends of bearing plate washers 128 rest on bottom surfaces 184 of the corresponding pairs of openings 168, 170. The bearing plate washers 128 are formed of steel and, as shown in FIG. 13, may be rectangular or T-shaped with a length, width and thickness of 3½ inches, 2½ inches, and 1 inch, respectively. Each of these dimensions may vary in further embodiments. Each bearing plate washer 128 may further include an anchor bolt hole having a diameter of 1.125 inches, though the hole may be larger or smaller than that in further embodiments.

In embodiments, the bearing plate washers 128 are attached to the stiffeners 124, 126 with a weld along three mated surfaces. The three-sided attachment strengthens the stiffeners 124, 126 and further increases the rotational stability of the shearwall 100. The attachment also allows the bearing plate washer 128 to resist the overturning force from the shearwall 100 in two-way bending further utilizing the material. In further embodiments, a two-sided attachment may be used to connect the bearing plate washers to the stiffeners.

In further embodiments, the bearing plate washer 128 may not bear on one or more of the bottom surfaces 184 of the corresponding pairs of openings 168, 170. Instead, the bearing plate washer 128 may be attached to the stiffeners 124, 126 and edge sections 110, 112 through weld, bolt and/or glue.

Figure 15:
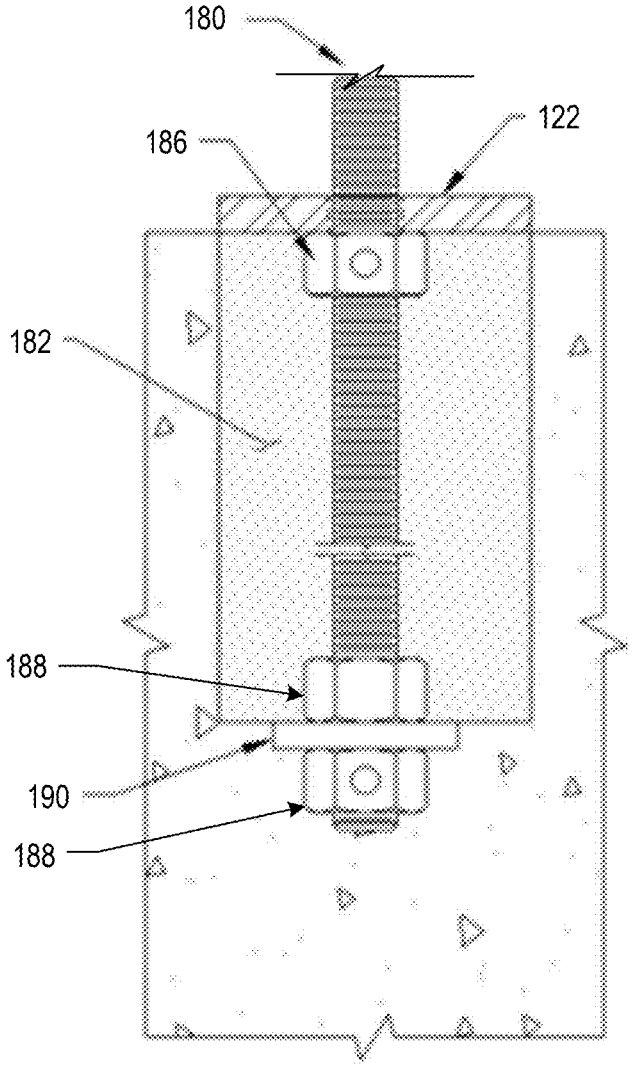
FIG. 15 is a cross-sectional side view showing a portion of the shearwall of the present technology mounted to a foundation.

Referring now to the exploded perspective view of FIG. 14 and the cross-sectional view of FIG. 15, the anchor bolts 180 extend up from the concrete foundation 182 or other support surface through the base plate 122 and into the side edges 110, 112 of shearwall 100. The anchor bolts 180 further extend up into the openings 168, 170 and through the bearing washers 128. Each anchor bolt 180 may then be affixed to a bearing plate washer 128 by the washer 129 and the nut 130 as shown for example in the exploded perspective view of FIG. 14. The height of each anchor bolt 180 above the foundation 182 may be set for example by a nut 186 fastened onto a lower portion of the anchor bolt within the foundation 182. The nut 186 is shown in FIG. 15 at a top of the foundation 182, beneath the base plate 122 of the shearwall 100. A number of additional nuts 188 and washers 190 may be mounted on the bottom end of bolt 180 to improve the ability of bolt 180 and shearwall 100 to transfer loads into the foundation 182. Other fastening schemes are possible to mount and hold the anchor bolt 180*s* within the foundation 182.

It has been found that tightening of the nuts 130 and removing slack within the shearwall 100 enhances the initial stiffness of the shearwall and increases the magnitude of lateral force that the shearwall may transmit at a given lateral displacement threshold. The nuts 130 within the anchor bolt openings 168, 170 may be tightened to remove any slack within the shearwall 100. In particular, by tightening the nuts 130, the bearing plate washers 128 pull down on the respective pairs of edge sections 110, 112 and stiffeners 124, 126, which in turn pull the central panel 102 against the second set of nuts 186 on anchor bolts 180. Without such tightening of the nuts 130, slack may exist in the attachment of the shearwall 100 to the support surface due to various manufacturing tolerances. Embodiments of the present technology may require that the nut 130 be tightened to a level defined as finger-tight plus one-half turn. This level of tightening may vary in further embodiments.

Figure 5:
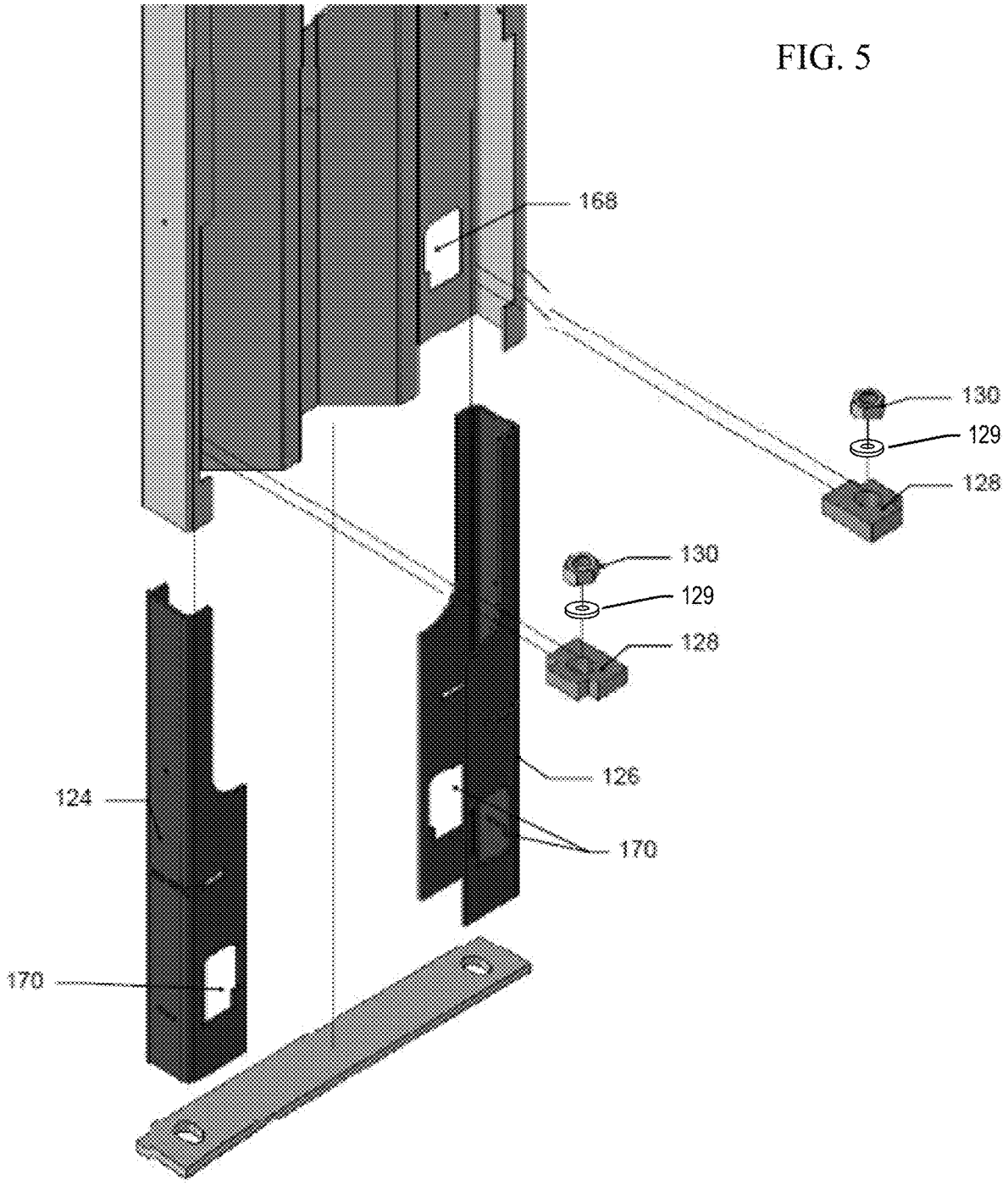
FIG. 5 is an enlarged exploded perspective view of a portion of the prefabricated shearwall according to the present technology.
Figure 6:
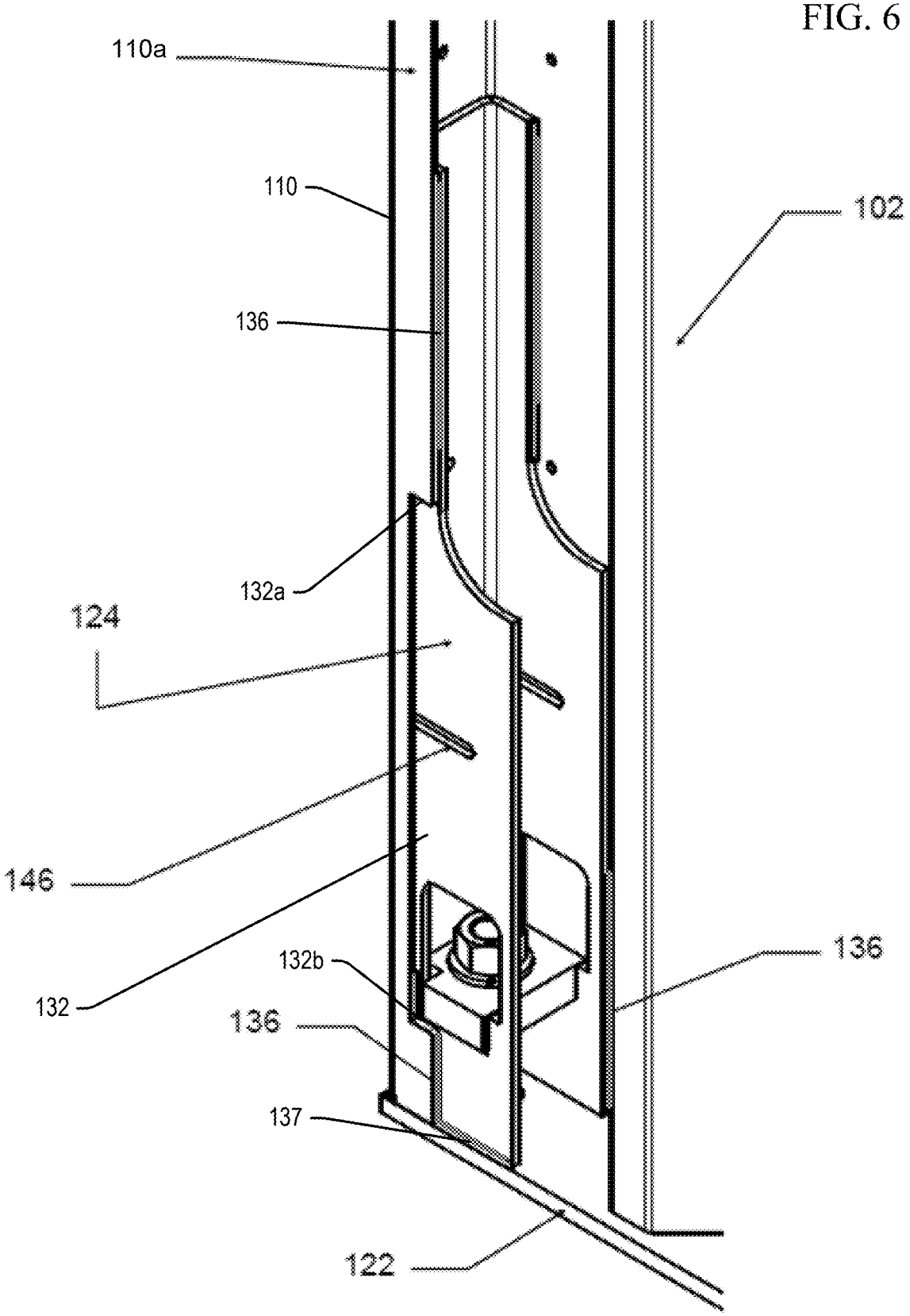
FIG. 6 is an enlarged perspective view of a portion of the prefabricated shearwall according to the present technology.
Figure 16:
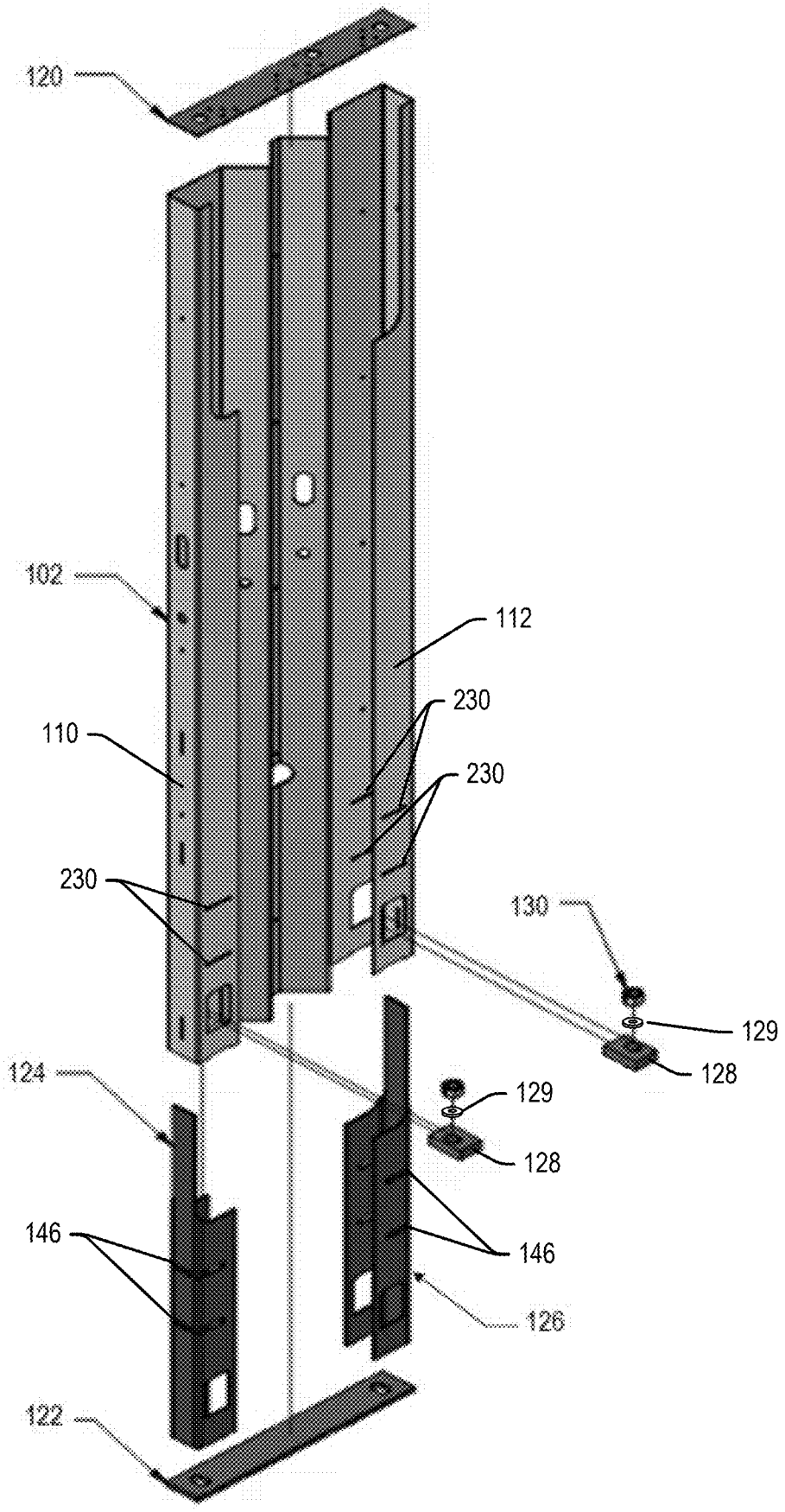
FIG. 16 is an exploded perspective view of a shearwall according to a further alternative embodiment of the present technology.
Figure 17:
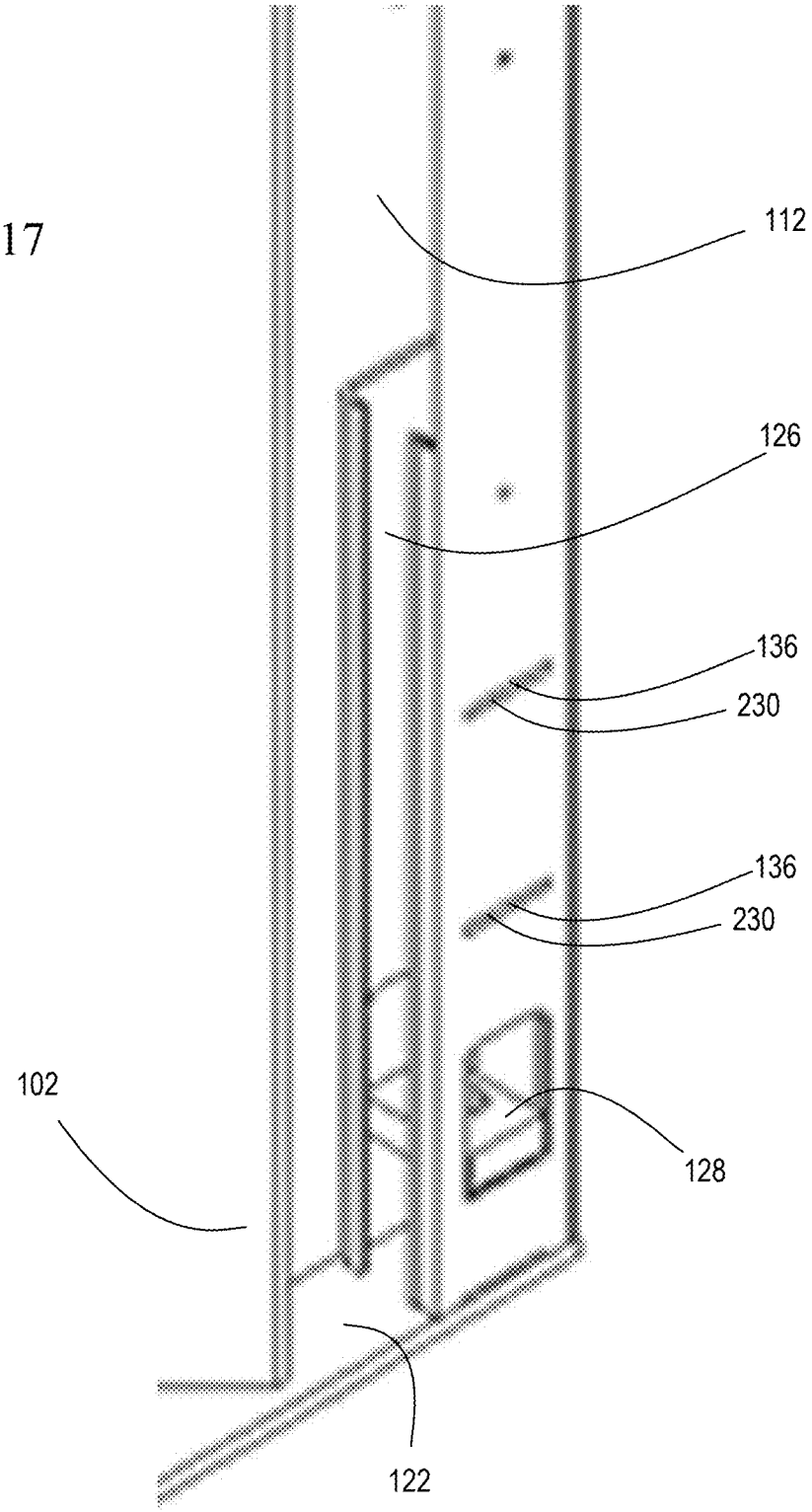
FIG. 17 is a partial perspective view showing a portion of a shearwall according to embodiments of the present technology.

In embodiments, the anchoring system shown in FIGS. 14 and 15 may be used to anchor the stiffeners 124, 126 and shearwall 100 shown for example in FIGS. 4-6. However the anchoring system shown in FIGS. 14 and 15 may be used to anchor any of the stiffeners 124, 126 described herein. For example, FIGS. 16 and 17 are exploded and enlarged perspective views, respectively, of a shearwall 100 including a pair of stiffeners 124, 126 having two slots 146 along their length. Such stiffeners 124, 126 are shown in FIGS. 8A and 8B described above. FIGS. 16 and 17 also shows an embodiment including horizontal welds 136 connecting the stiffeners 124, 126 to the edge sections 110, 112. The horizontal welds may be made through slits 230 formed in the edge section 112. While two horizontal welds 136/slits 230 are shown, there may be one or more than two welds 136/slits 230, and the welds 136/slits 230 need not be horizontal in further embodiments.

In summary, the present technology relates to a shearwall, comprising: a central panel; edge sections at edges of the central panel; and internal stiffeners mounted within and coupled to the edge sections, the internal stiffeners configured to increase a section modulus of the shearwall and mitigate control buckling of the shearwall at the edge sections of the shearwall.

In another example, the present technology relates to a shearwall, comprising: a central panel; edge sections at edges of the central panel, the edge sections and central panel including a base section adjacent a lower portion of the shearwall; and internal stiffeners mounted within and coupled to the edge sections at the base section, the internal stiffeners configured to increase a section modulus of the shearwall and control buckling of the shearwall at the edge sections at the base section of the shearwall.

In a further example, the present technology relates to a shearwall, comprising: a central panel; edge sections at edges of the central panel; internal stiffeners mounted within and coupled to the edge sections, the internal stiffeners configured to increase a section modulus of the shearwall and control buckling of the shearwall at the edge sections of the shearwall; one or more slots, each of the one or more slots having a pair of ends comprising rotational yield points; and a slot fuse tab extending transversely across a section of at least one of the slots.

Although the technology has been described in detail herein, it should be understood that the technology is not limited to the embodiments herein disclosed. Various changes, substitutions and modifications may be made thereto by those skilled in the art without departing from the spirit or scope of the technology as described and defined by the appended claims.

What is claimed is:

1. A shearwall, comprising:
a central panel;
edge sections at edges of the central panel; and
internal stiffeners mounted within and coupled to the edge sections, the internal stiffeners configured to increase a section modulus of the shearwall and control buckling of the shearwall at the edge sections of the shearwall;
wherein the internal stiffeners comprise one or more slots configured to widen or narrow upon lateral loads on the shearwall above a threshold.

2. The shearwall of claim 1, wherein the edge sections are configured to buckle or expand at positions corresponding to positions of the one or more slots in the internal stiffeners.

3. The shearwall of claim 1, wherein the one or more slots comprise a pair of slots along a length of each stiffener.

4. The shearwall of claim 1, wherein each stiffener includes a back portion, and respective side portions extending at an angle to the back portion.

5. The shearwall of claim 4, wherein the slots are formed in one or more of the back portion and respective side portions.

6. The shearwall of claim 4, wherein the slots are formed in each of the back portion and respective side portions.

7. The shearwall of claim 4, wherein the back portion is longer than the respective side portions.

8. The shearwall of claim 1, wherein the edge sections and internal stiffeners include openings that align with each other, the openings configured to receive bearing plate washers and nuts to affix the shearwall to a foundation.

9. The shearwall of claim 1 further comprising a pair of bearing plate washers and a pair of nuts, a bearing plate washer and a nut of the pair of bearing plate washers and a pair of nuts fitting within openings in an edge section and internal stiffener and configured to receive an anchor bolt to affix the shearwall to a foundation.

10. A shearwall, comprising:
a central panel;
edge sections at edges of the central panel, the edge sections and central panel including a base section adjacent a lower portion of the shearwall;
internal stiffeners mounted within and coupled to the edge sections at the base section, the internal stiffeners configured to increase a section modulus of the shearwall and control buckling of the shearwall at the edge sections at the base section of the shearwall;
a baseplate at a bottom of the base section;
one or more welds coupling the internal stiffeners to the edge sections; and one or more welds coupling the internal stiffeners to the baseplate, wherein the internal stiffeners are coupled to the edge sections by one or more welds.

11. The shearwall of claim 10, wherein the internal stiffeners comprise one or more slots, each of the one or more slots having a pair of ends comprising rotational yield points.

12. The shearwall of claim 11, wherein a slot of the one or more slots further comprises a slot fuse tab extending transversely across a section of the slot.

13. The shearwall of claim 11, wherein a slot of the one or more slots has a variable gap width along a length of the slot.

14. The shearwall of claim 12, wherein the internal stiffeners are configured to yield first at the slot fuse tab.

15. The shearwall of claim 14, wherein the internal stiffeners are configured to yield first at the slot fuse tab by the slot fuse tab breaking.

16. The shearwall of claim 14, wherein, upon yielding of the slot fuse tab, loads are transferred to the rotational yield points.

17. The shearwall of claim 16, wherein the internal stiffeners are configured to yield second at the rotational yield points.

18. The shearwall of claim 11, wherein a slot of the one or more slots has a constant gap width along a length of the slot.

19. The shearwall of claim 10, wherein the one or more welds coupling the internal stiffeners to the edge sections comprise a plurality of welds between edges of the internal stiffeners and the edge sections.

20. The shearwall of claim 10, wherein the one or more welds comprise a plurality of welds formed in slits through the edge sections.

21. The shearwall of claim 10, further comprising first and second reinforcement plates positioned in the edge sections to resist torsional loads on the shearwall.

22. The shearwall of claim 10, further comprising a torsion strap affixed across a width of the shearwall to resist torsional loads on the shearwall.

23. The shearwall of claim 10, further comprising a pair of cords affixed to exterior surfaces of the edge sections to resist torsional loads on the shearwall.

24. A shearwall, comprising:

a central panel;

edge sections at edges of the central panel;

internal stiffeners mounted within and coupled to the edge sections, the internal stiffeners configured to increase a section modulus of the shearwall and control buckling of the shearwall at the edge sections of the shearwall;

one or more slots, each of the one or more slots having a pair of ends comprising rotational yield points; and a slot fuse tab extending transversely across a section of at least one of the slots.

25. The shearwall of claim 24, wherein the internal stiffeners are configured to yield first at the slot fuse tab.

26. The shearwall of claim 25, wherein the internal stiffeners are configured to yield second at the rotational yield points.

* * * * *